US008544949B2

(12) United States Patent
Taton

(10) Patent No.: US 8,544,949 B2
(45) Date of Patent: Oct. 1, 2013

(54) INFANT SUPPORT STRUCTURE WITH ELECTRONIC HUB

(75) Inventor: Justin C. Taton, Clarence, NY (US)

(73) Assignee: Mattel, Inc., El Segudo, CA (US)

( * ) Notice: Subject to any disclaimer, the term of this patent is extended or adjusted under 35 U.S.C. 154(b) by 693 days.

(21) Appl. No.: 12/571,511

(22) Filed: Oct. 1, 2009

(65) Prior Publication Data

US 2010/0109398 A1 May 6, 2010

Related U.S. Application Data

(60) Provisional application No. 61/109,756, filed on Oct. 30, 2008.

(51) Int. Cl.
*A47C 7/72* (2006.01)
*A47C 31/00* (2006.01)

(52) U.S. Cl.
USPC ..... 297/217.4; 297/219.12; 297/224; 297/DIG. 11

(58) Field of Classification Search
USPC ..... 297/217.4, 219.12, 224, DIG. 11
See application file for complete search history.

(56) References Cited

U.S. PATENT DOCUMENTS

| | | | | |
|---|---|---|---|---|
| 4,640,034 | A | 2/1987 | Zisholtz | |
| 4,782,533 | A | 11/1988 | Haynie | |
| 4,793,010 | A | 12/1988 | Gross et al. | |
| 4,841,587 | A | 6/1989 | Carter et al. | |
| 4,862,438 | A | 8/1989 | Fry | |
| 4,979,777 | A | 12/1990 | Takada | |
| 5,014,376 | A | 5/1991 | Doran et al. | |
| 5,265,932 | A | 11/1993 | Leonard | |
| 5,357,642 | A | 10/1994 | Clute | |
| 5,482,352 | A | 1/1996 | Leal et al. | |
| 5,509,721 | A * | 4/1996 | Huang | 297/452.13 |
| 5,624,156 | A | 4/1997 | Leal et al. | |
| 6,431,646 | B1 | 8/2002 | Longoria | |
| 6,578,912 | B2 | 6/2003 | Hansen et al. | |
| 6,592,425 | B2 * | 7/2003 | Bapst et al. | 446/227 |
| 6,764,133 | B2 | 7/2004 | Osato | |
| 6,899,365 | B2 | 5/2005 | Lavelle et al. | |
| 7,039,207 | B1 | 5/2006 | Elrod et al. | |
| 7,077,405 | B2 | 7/2006 | Akpom | |
| 7,255,393 | B2 | 8/2007 | Flanagan | |
| 7,329,192 | B2 * | 2/2008 | Gibree | 472/119 |
| 7,333,627 | B2 | 2/2008 | Ventrola et al. | |
| 7,431,395 | B2 * | 10/2008 | Morgan et al. | 297/219.12 |
| 2003/0020317 | A1 * | 1/2003 | Keegan et al. | 297/446.2 |
| 2005/0151401 | A1 | 7/2005 | Evans | |
| 2007/0111809 | A1 * | 5/2007 | Bellows et al. | 472/118 |
| 2007/0179415 | A1 | 8/2007 | Evans | |
| 2008/0073953 | A1 | 3/2008 | Tamara | |
| 2008/0136229 | A1 * | 6/2008 | Papageorge et al. | 297/217.5 |

FOREIGN PATENT DOCUMENTS

| | | | |
|---|---|---|---|
| JP | 09191984 | A | 7/1997 |
| JP | 10075850 | A | 3/1998 |

* cited by examiner

*Primary Examiner* — David Dunn
*Assistant Examiner* — Tania Abraham
(74) *Attorney, Agent, or Firm* — Edell, Shapiro & Finnan LLC

(57) ABSTRACT

An infant support structure with which an electronic device can be used is disclosed. In one embodiment, the infant support structure is configured to be used with an electronic device that can enhance the experience of an infant or child on the infant support structure. In addition, softgoods for an infant support structure is disclosed.

13 Claims, 25 Drawing Sheets

INFANT SUPPORT STRUCTURE WITH ELECTRONIC HUB

CROSS-REFERENCE TO RELATED APPLICATION

This application claims priority to U.S. Provisional Patent Application Ser. No. 61/109,756, entitled "Infant Support Structure," filed Oct. 30, 2008, the disclosure of which is incorporated herein by reference in its entirety.

FIELD OF THE INVENTION

The present invention relates to an infant support structure with which an electronic device can be used. In particular, the present invention relates to an infant support structure that is configured to be used with a removable or detachable electronic device that can enhance the experience of an infant or child on the infant support structure. In addition, the present invention relates to softgoods that can be used with an infant support structure. In particular, the softgoods are configured to resist movement of the softgoods relative to the frame of the infant support structure.

BACKGROUND OF THE INVENTION

Conventional infant support structures provide support for a child or infant. Some examples of such infant support structures include, but are not limited to, bouncers, swings, infant seats, and high chairs. Many times an infant on an infant support structure needs some form of entertainment to soothe or calm or otherwise entertain the infant. In some instances, audible outputs, such as speech and/or sound effects, are generated or played for an infant. However, in some infant support structures, the variety of audible outputs is fixed and limited.

In addition, some conventional infant support structures include a fabric softgoods portion that is mounted to a frame. The softgoods portion provides a comfortable surface or receiving area on which an infant can be placed.

Therefore, there is a need for an infant support structure with which an entertainment component can easily be used. The need exists for an infant support structure that accommodates an electronic device that can be easily coupled and decoupled from the infant support structure. In addition, there is a need for a softgoods portion that is mountable to a frame and that resists undesired movement of the softgoods portion relative to the frame.

SUMMARY OF THE INVENTION

The present invention relates to an infant support structure that includes a frame with a child receiving portion. The frame is configured to receive an electronic device that can be used with an electronic system to generate outputs, such as audible and visual outputs. In one embodiment, electronic device can be removably mounted to the frame. The frame can be configured to receive the electronic device and securely couple it to the frame.

In one embodiment, a portion of an electronic system can be coupled to the frame. The electronic device can be connected to the electronic system and outputs can be generated by the electronic system in response to signals received from the electronic device. The outputs may include audible outputs, such as music, sounds, and/or speech, and/or visual outputs.

In another embodiment, the present invention relates to an infant support structure that includes a frame and a softgoods portion that is coupleable to the frame. The softgoods portion includes one or more resilient members coupled thereto which stiffen or strengthen a mounting portion of the softgoods, thereby resisting the movement of the softgoods relative to the frame.

In one embodiment, the infant support structure includes a base frame portion that is configured to engage a support surface, a seat frame portion that is configured to support an infant, and a coupling assembly. The coupling assembly is coupled to the base frame portion and to the seat frame portion, and is configured to support the seat frame portion on the base frame portion. The coupling assembly includes a housing defining a receptacle that is configured to receive an electronic device. The housing includes an output generating device configured to generate an output based on signals from the electronic device.

In one embodiment, the base frame portion includes a lower portion and an upper portion, the upper portion is configured to be coupled to the lower portion, and the housing of the coupling assembly is connected to the lower portion. In an alternative embodiment, the coupling assembly may include a second housing. In this implementation, the base frame portion has a first side and an opposite second side, and one housing is located on the first side of the base frame portion and the other housing being located on the second side of the base frame portion.

In one embodiment, the seat frame portion includes a tubular member with a first end and a second end, and the housing is configured to receive the first end and the second end of the tubular member. The housing may include a cover removably coupled thereto, the cover being configured to cover the receptacle. The cover has an opening formed therein that is configured to receive a connection therethrough so that the connection can be coupled to the electronic device. In one implementation, the housing of the frame includes a wire with a jack extending therefrom, and an opening in the cover is configured to receive the wire and the jack therethrough.

In one embodiment, the housing includes a mounting portion that defines a receiving area, the receiving area being configured to receive a portion of the cover to couple the cover to the housing. Alternatively, the housing may includes a retaining member proximate to the receptacle, the retaining member being elastic and configured to retain the electronic device in the receptacle.

In another embodiment, a bouncer according to the present invention includes a lower portion, a child receiving portion, a first connector, and a second connector. The first connector is coupled to the lower portion and to the child receiving portion, and is disposed on a first side of the bouncer. The second connector is coupled to the lower portion and to the child receiving portion. The second connector is disposed on a second side of the bouncer opposite the first side. The first connector and second connector are configured to support the child receiving portion on the lower portion. The second connector includes a receptacle formed therein to receive an electronic device, the receptacle being configured so that the electronic device is removable from the second connector. The second connector also includes an electronic system that is configured to generate an output based on signals from the electronic device.

In one embodiment, the lower portion is a wire frame, and the child receiving portion includes a tubular member coupled to the first connector and the second connector. The child receiving portion includes a softgoods portion coupled to the child receiving portion to support an infant thereon. The second connector includes a cover removably coupled thereto, the cover being configured to cover the receptacle.

The second connector may include a first mounting portion and a second mounting portion. Each of the first mounting portion and the second mounting portion is located proximate to the receptacle. The first mounting portion is configured to receive a first portion of the cover and the second mounting portion is configured to receive a second portion of the cover. The cover has an opening formed therein. The opening is configured to receive an electrical connection therethrough. The electrical connection being configured to couple the electronic device to the electronic system.

In another embodiment, the infant support structure includes a frame having an upper side and a lower side, and a support portion that is configured to support an infant thereon. The support portion includes a body configured to be disposed on the upper side of the frame, the body having an upper side, a lower side, an upper end, and a lower end. The support portion also includes a first mounting portion and a second mounting portion. The first mounting portion is coupled to the body proximate to the upper end and defines a receptacle with the lower side of the body to receive a first portion of the frame. The second mounting portion is coupled to the body proximate to the lower end. The second mounting portion defines a receptacle with the lower side of the body to receive a second portion of the frame. The second mounting portion includes a body portion and at least one resilient member coupled to the body portion. The resilient member limits the movement of the second mounting portion relative to the frame when an infant is disposed on the support portion.

In one implementation, the second mounting portion includes an inner side and an outer side, and the at least one resilient member is coupled to the inner side of the second mounting portion. Alternatively, the second mounting portion may include several resilient members coupled thereto, and each of the resilient members is spaced apart from adjacent resilient members. The second mounting portion is disposed on the lower side of the frame and is configured to limit movement of the second mounting portion around the second portion of the frame.

In an alternative embodiment, according to the present invention, a bouncer includes a frame and a softgoods portion. The frame includes a support portion and a child receiving portion coupled to the support portion, the support portion being configured to engage a support surface. The child receiving portion of the frame has an upper end and a lower end. The softgoods portion has a body portion with a first member and a second member coupled thereto. The first member and the body portion defining a first receptacle configured to receive the upper end of the frame, and the second member and the body portion defining a second receptacle configured to receive the lower end of the frame. The softgoods portion includes at least one resilient member coupled to the second member. The resilient member being configured to limit movement of the second member relative to the frame when an infant is disposed on the softgoods portion. In an alternative embodiment, the softgoods portion includes several resilient members coupled to the second member, and each of the resilient members is spaced apart from adjacent resilient members. The second member includes an inner surface and each resilient member is coupled to the inner surface of the second member.

BRIEF DESCRIPTION OF THE DRAWINGS

Like reference numerals have been used to identify like elements throughout this disclosure.

DETAILED DESCRIPTION OF THE INVENTION

Figure 1:
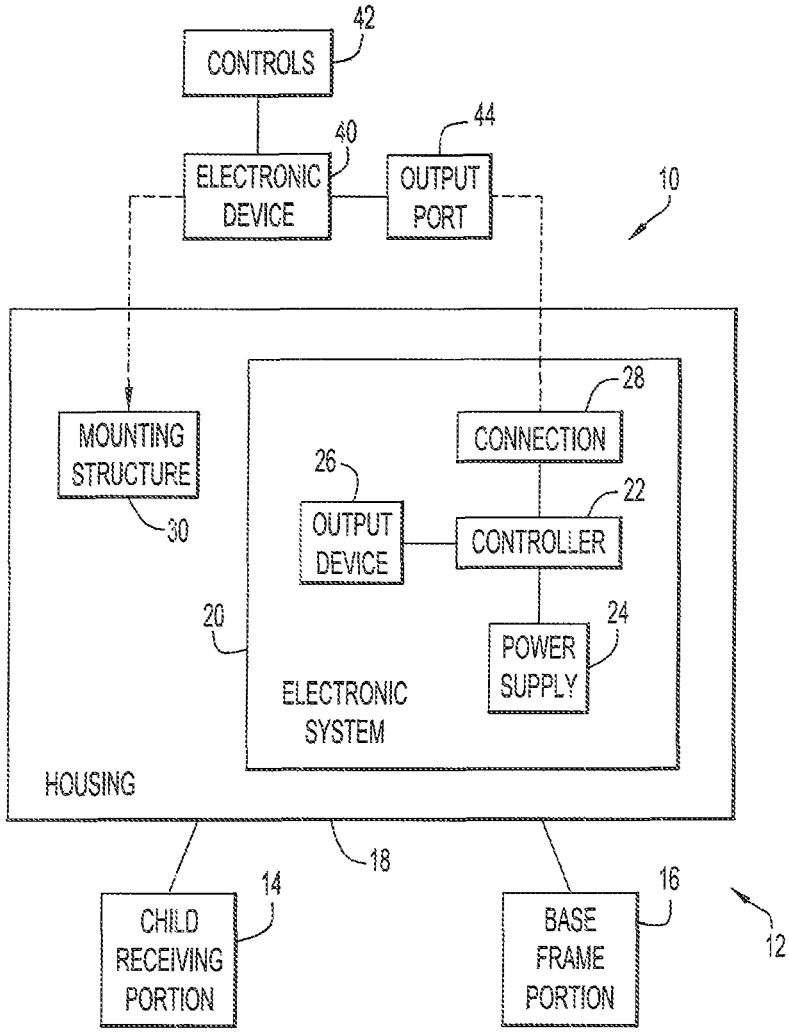
FIG. 1 illustrates a schematic block diagram of an embodiment of an infant support structure according to the present invention.

Referring to FIG. 1, an embodiment of an infant support structure according to the present invention is illustrated. The infant support structure 10 includes a frame 12. In one embodiment, the frame 12 includes a base frame portion 16 and a child receiving portion 14. The child receiving portion 14 is configured to receive and/or support an infant thereon. For example, the child receiving portion 14 may be a seat for a bouncer, swing, or a high chair. The base frame portion 16 is configured to engage a support surface to support the frame 12 thereon. In this embodiment, the frame 12 includes a housing or connector 18 to which the child receiving portion 14 can be coupled. The housing 18 can be coupled to and supported by the base frame portion 16. In different embodiments of the infant support structure 10, the child receiving portion 14 can be fixedly coupled or movably coupled to the housing 18.

As shown in FIG. 1, the housing 18 includes an electronic system 20. In this embodiment, the electronic system 20 includes a controller or microprocessor 22 that is connected to a power supply 24. The power supply 24 may include one or more batteries. An output device 26, which may be a speaker or transducer for audible outputs or a display or screen for visual outputs, is connected to the controller 22 as well. The electronic system 20 also includes a connection 28 that is electrically connected to the controller 22.

The housing 18 includes a mounting structure 30 that is configured to be used to mount an electronic device 40 to the housing 18. In one implementation, the mounting structure 30 can be a receptacle or recess that is formed in the housing 18. The mounting structure 30 permits the removal of the electronic device 40 from the housing 18 by a parent or caregiver. Additional components such as a strap or coupling mechanism may be utilized to couple the electronic device 40 to the housing 18.

In one implementation, the electronic device 40 may be an audible output device, such as an IPOD, IPHONE, mp3 player or other device. In other implementations, the electronic device 40 may be any type of device that can store and generate signals indicative of audible and/or visual media. Referring to FIG. 1, the electronic device 40 may include controls or a control portion 42 that can be manipulated by a user to select a particular output, such as a song, and change the output, such as by adjusting the volume. The electronic device 40 includes an output port 44 that can be used to electrically connect the electronic device 40 to the connection 28 of the electronic system 20. The connection 28 can be a wire with a jack that can be inserted into the output port 44.

Figure 2:
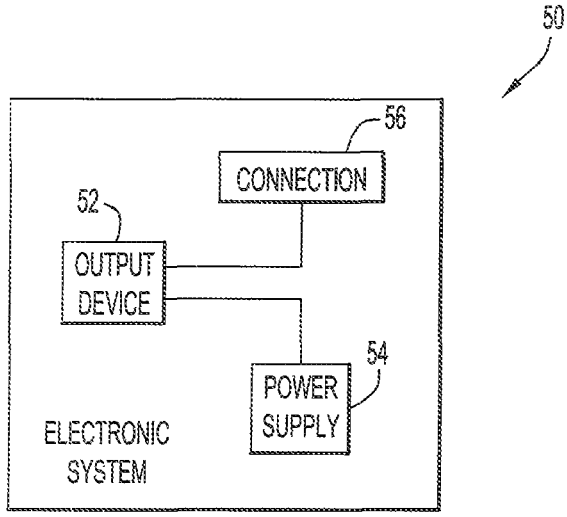
FIG. 2 illustrates a schematic block diagram of an alternative embodiment of an electronic system for an infant support structure according to the present invention.

Referring to FIG. 2, an alternative embodiment of an electronic system that can be used with infant support structure 10 according to the present invention is illustrated. In this embodiment, the electronic system 50 includes an output device 52, such as a speaker or transducer, and a power supply 54 connected to the output device 52. A connection 56, such as a wire and a connector or jack, can be used to connect the electronic system 50 to an electronic device.

Figure 3:
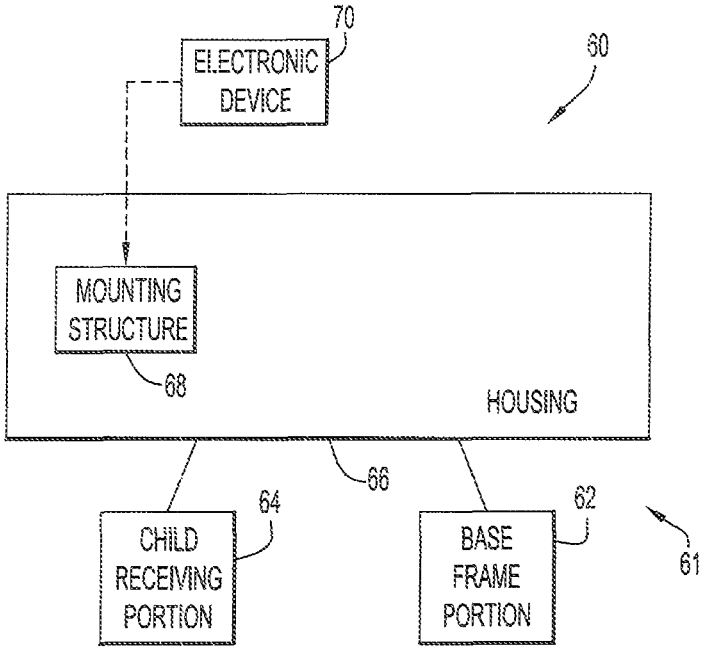
FIG. 3 illustrates a schematic block diagram of an alternative embodiment of an infant support structure according to the present invention.

Referring to FIG. 3, an alternative embodiment of an infant support structure according to the present invention is illustrated. In this embodiment, the infant support structure 60 includes a frame 61 with a base frame portion 62 and a child receiving portion 64. The frame 61 also includes a housing 66 coupled to the base frame portion 62 and to which the child receiving portion 64 is coupled. As shown, the housing 66 includes a mounting structure 68, such as a receptacle or recess, to which an electronic device 70 can be mounted. The electronic device 70 is removable from the housing 66 and in particular, from the mounting structure 68. A parent or caregiver 70 can manipulate the electronic device 70 to select a particular output or outputs for the infant on the infant support structure 60. When the outputs are selected, the electronic device 70 can be mounted to the frame 61. Alternatively, the parent or caregiver can manipulate the controls of the electronic device 70 to select particular outputs while the electronic device 70 is coupled to the frame 61.

Figure 4:
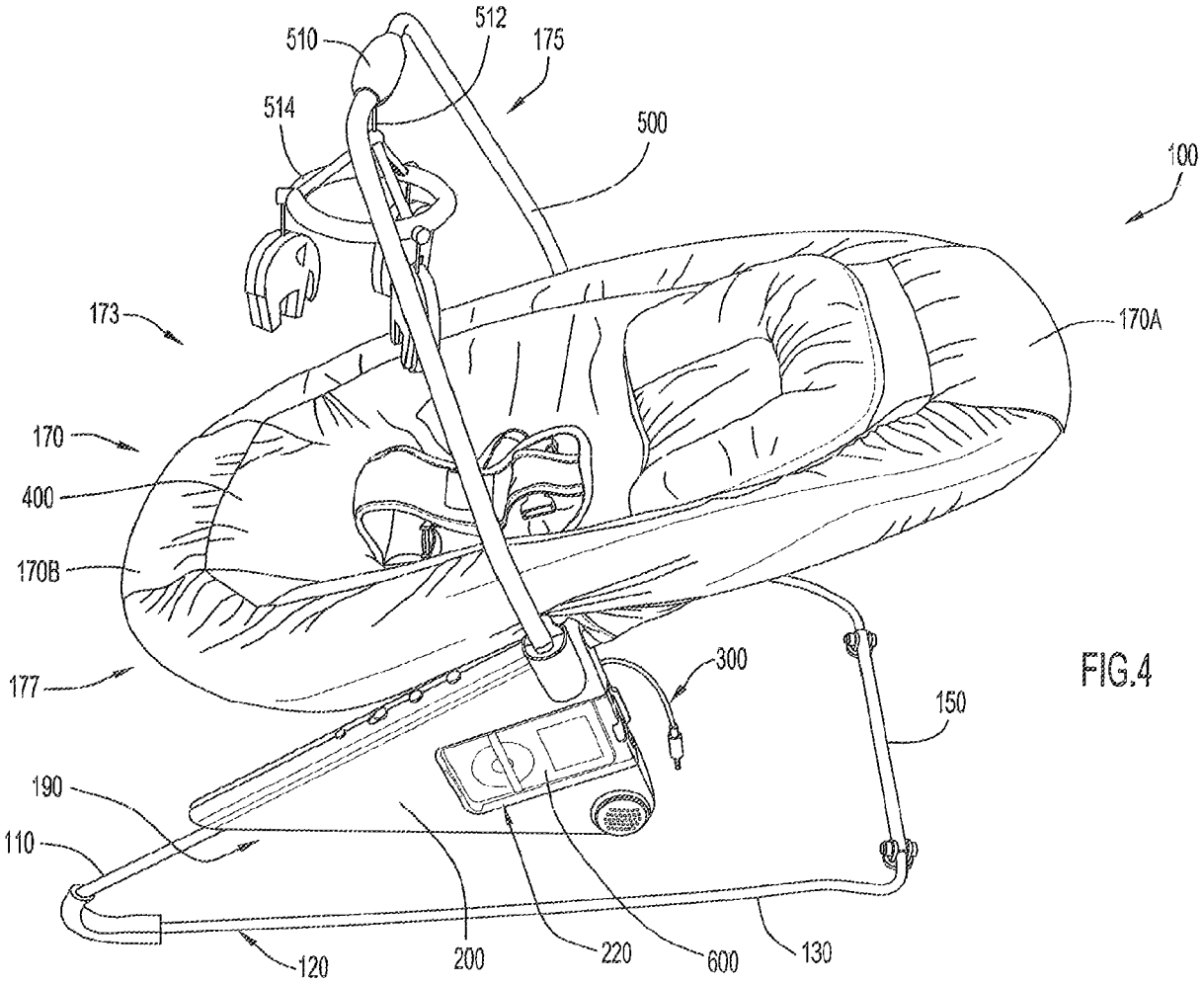
FIG. 4 illustrates a perspective view of an embodiment of an infant support structure according to the present invention.

Referring to FIG. 4, an embodiment of an infant support structure according to the present invention is illustrated. In this embodiment, the infant support structure is a bouncer. However, in alternative embodiments, the infant support structure may be a high chair, a swing, or other structure configured to support an infant or child. As shown in FIG. 4, the infant support structure 100 is disposed on a support surface. The infant support structure 100 includes a frame 110 that is configured to be supported on the support surface. The frame 110 includes a seat portion or child receiving portion 170. The child receiving portion 170 includes a softgoods portion or assembly 400 that is configured to receive an infant or child thereon or therein. Coupled to the frame 110 proximate to the child receiving portion 170 is an entertainment component or portion 175. The entertainment portion 175 includes a toy bar 500 with a mounting portion 510 from with a string 512 a mobile or ring 514 coupled thereto.

Referring to FIG. 4, the frame 110 includes a lower portion or base frame portion 120 that is configured to be placed on support surface 90. The child receiving portion 170 forms an upper portion of the frame 110. The child receiving portion 170 has an upper end 170A and a lower end 170B. The frame 110 has an upper side 173 and a lower side 177. The frame 110 also includes first side member 130 and a second side member 140 (see FIG. 5) that are disposed on the first side 112 and the second side 114 of the frame 110, respectively. The first side member 130 and the second side member 140 are coupled to each other by a rear or connecting member 150 (see FIG. 4). The rear member 150 can be configured to receive the lower rear ends of the first side member 130 and the second side member 140 and be secured thereto by fasteners, such as screws.

As shown in FIG. 4, the frame 110 also includes a coupling assembly 190 that is configured to support the upper frame portion or child receiving portion 170 on the lower frame portion 130. The coupling assembly 190 includes a housing or connector 200 disposed on one side of the frame 110. In this embodiment, the housing 200 includes a mounting structure or receptacle 220 formed therein in which an electronic device 600 can be placed. The housing 220 includes a connection or connector 300 that can be connected to the electronic device 600 to couple the electronic device 600 to an electronic system or components in the housing 200. In FIG. 4, the connector 300 is illustrated as being disconnected from the electronic device 600.

Figure 5:
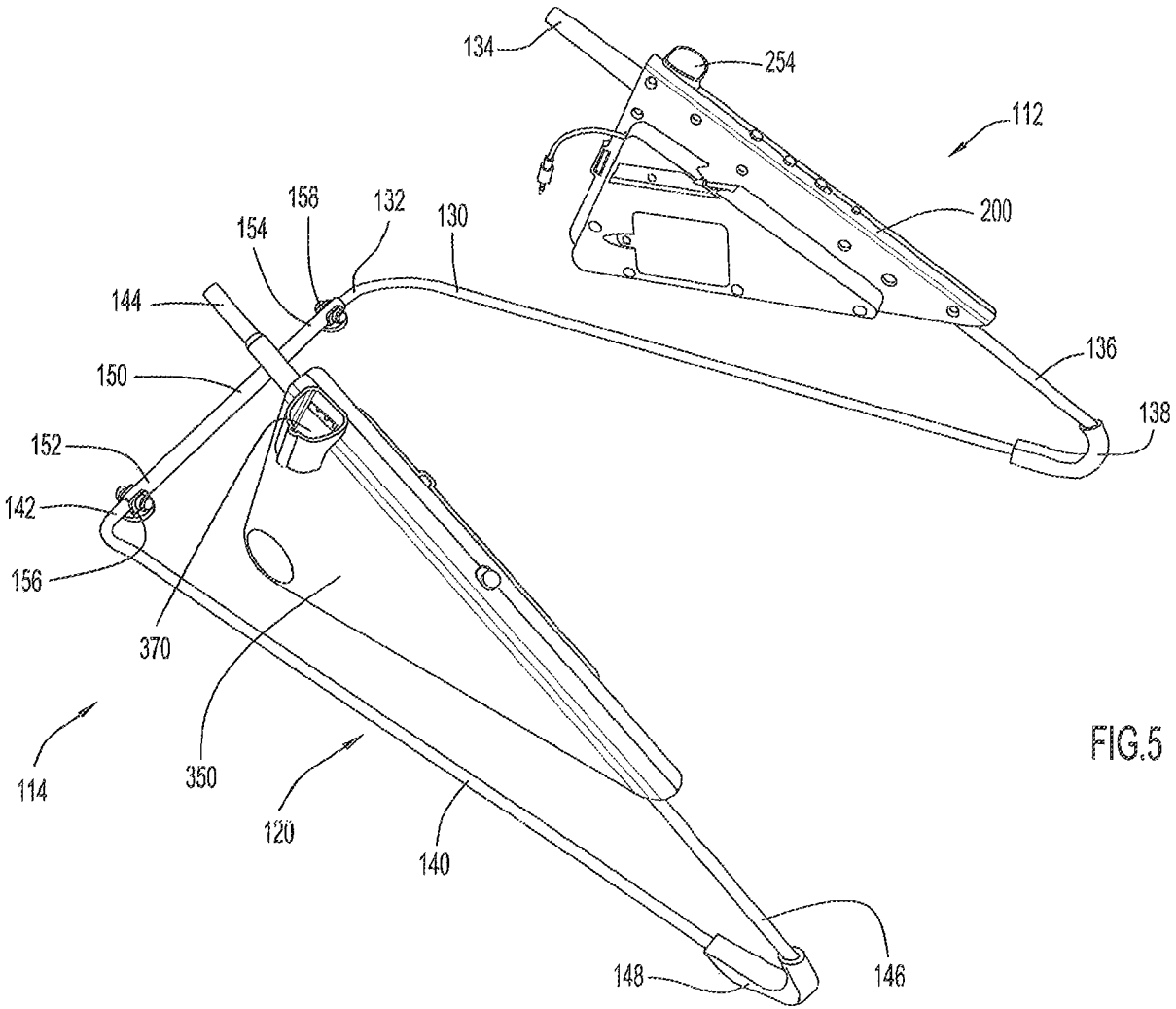
FIG. 5 illustrates a perspective view of a portion of the frame of the infant support structure illustrated in FIG. 4.

Referring to FIG. 5, some of the features of the frame 110 are illustrated. The child receiving portion 170 and the toy bar 500 are removed from the frame 110 for ease of reference for discussion of the other components of the frame 110. As shown in FIG. 5, the frame 110 includes a first side member or portion 130 on a first side 112 of the frame 110 and a second side member or portion 140 on a second side 114 of the frame 110. The rear member 150 includes ends 152 and 154 that are configured to receive lower ends 142 and 132 of the side members 140 and 130, respectively. Couplers 156 and 158, with fasteners such as screws, can be used to connect the respective ends of the rear member 150 and the side members 130 and 140 together.

Side member 130 includes an upper end 134 and a front portion 136 with an engagement member 138 mounted thereon. Mounted on the side member 130 is a connector or housing 200, which can be referred to alternatively as a hub. The connector 200 includes an opening or receptacle 254 in which an end of the toy bar 500 can be inserted. Similarly, side member 140 includes an upper end 144 and a front portion 146 with an engagement member 148 mounted thereon. Mounted on the side member 140 is a connector or housing 350, which can be referred to as a hub as well. The connector 350 includes an opening or receptacle 370 in which another end of the toy bar 500 can be inserted.

Figure 6:
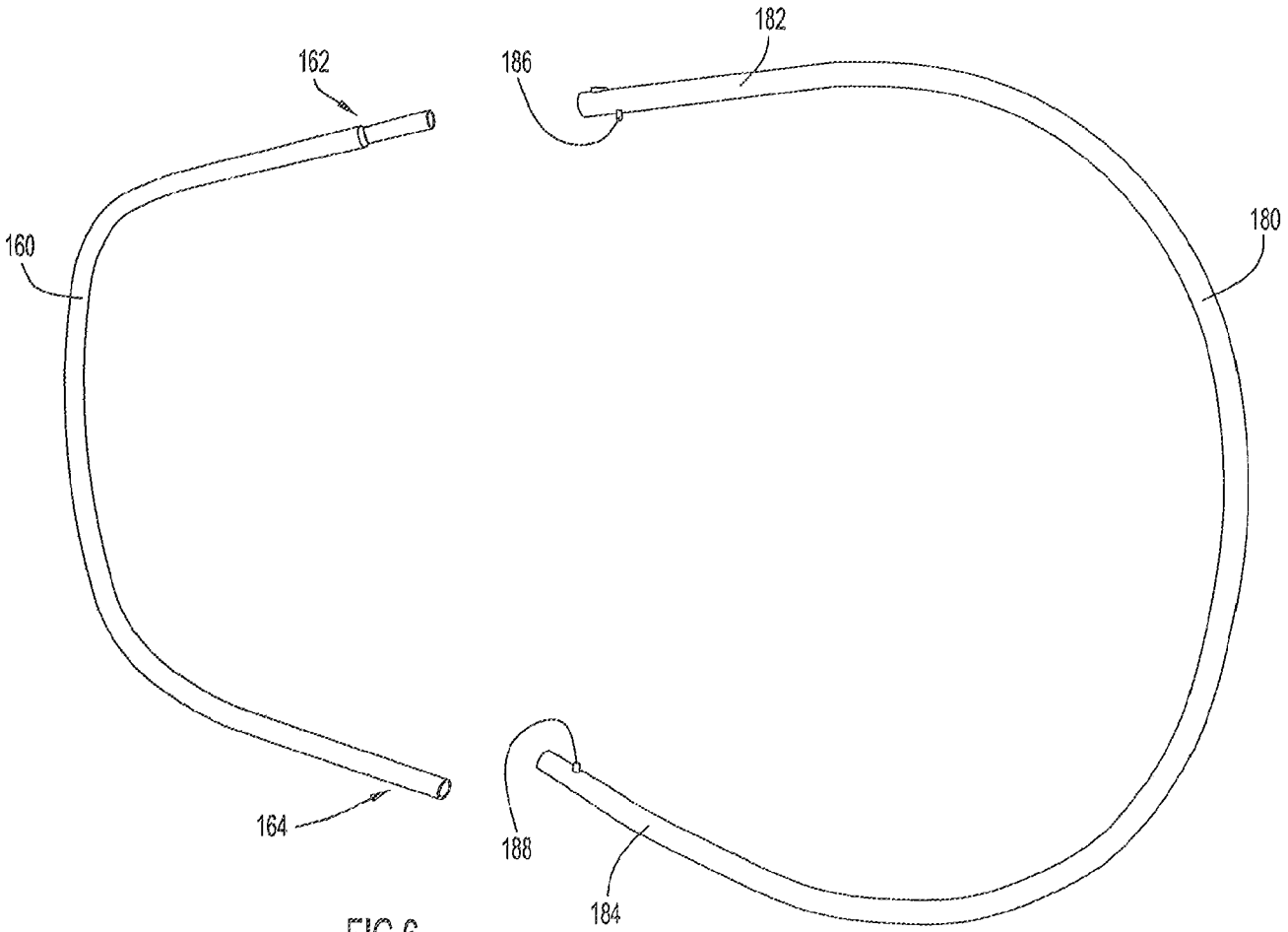
FIG. 6 illustrates a top view of some components of the frame of the infant support structure illustrated in FIG. 4.
Figure 7:
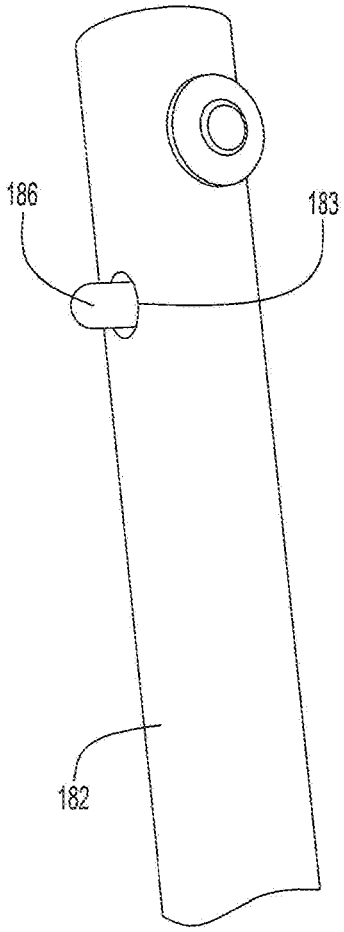
FIG. 7 illustrates a close-up view of a portion of a frame component illustrated in FIG. 6.

Referring to FIG. 6, the frame 110 includes an upper tubular member or portion 160 with ends 162 and 164 that are coupleable with ends 134 and 144, respectively, of side members 130 and 140. The frame 110 also includes a lower tubular member or portion 180 that forms part of the child receiving portion 170. The portion 180 has ends 182 and 184 that are inserted into the connectors 200 and 350, respectively. The ends 182 and 184 include couplers 186 and 188, respectively, that are used to couple the ends 182 and 184 to the connectors 200 and 350 and subsequently facilitate decoupling of the ends 182 and 184 as well. Referring to FIG. 7, end 182 includes an opening 183 through which a projection of the coupler 186 can extend. The couplers 186 and 188 can be spring-like tab structures or valco buttons.

Figure 8:
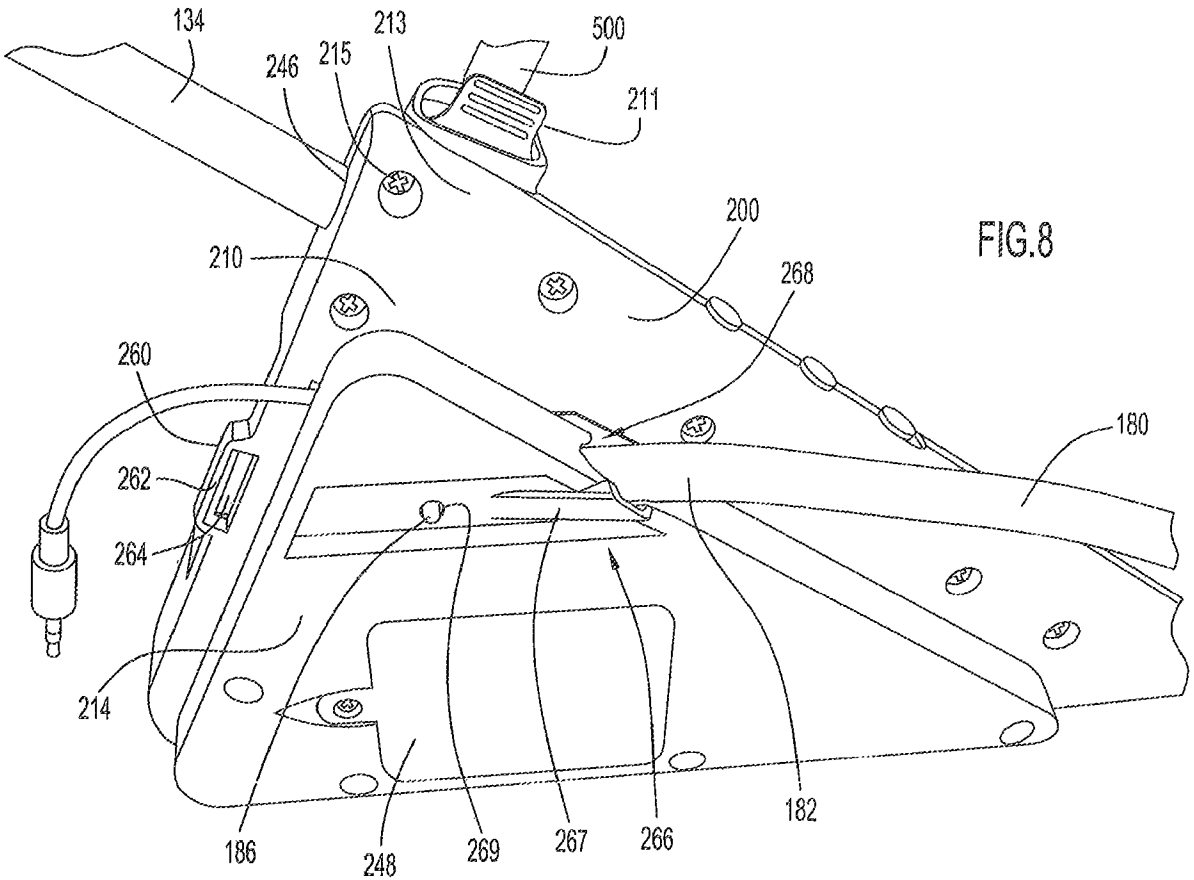
FIG. 8 illustrates a side view of a connector of the frame of the infant support structure illustrated in FIG. 4.

Referring to FIG. 8, an inner side of the connector 200 with toy bar 500 coupled thereto is illustrated. As shown, the connector 200 is mounted on the side member 130 and end 134 extends upwardly from the connector 200 through an opening 246. The connector 200 has a body 210 with an outer side 212 (see FIG. 9) and an inner side 214 (see FIG. 8). As shown in FIG. 8, the body 210 can be formed in two portions 211 and 213 that are coupled together using fasteners 215, such as screws. The body 210 includes a mounting portion 266 that includes a wall or wall portion 267 that defines a receptacle 268 and an opening 269. The receptacle 268 is configured to receive therein the end 182 of the portion 180. The coupler 186 of end 182 is configured to extend outwardly through opening 269 and is positioned to be manipulated by a user to decouple the member 180 from the connector 200. The body 210 also includes a battery compartment 248 with a cover as shown.

The connector 200 also includes a mounting portion 260 which is used to couple a cover (not shown in FIG. 8) over the receptacle of the connector 200. The mounting portion 260 includes a bar 262 that defines a receiving area 264. The mounting portion 260 is described in greater detail below.

Figure 9:
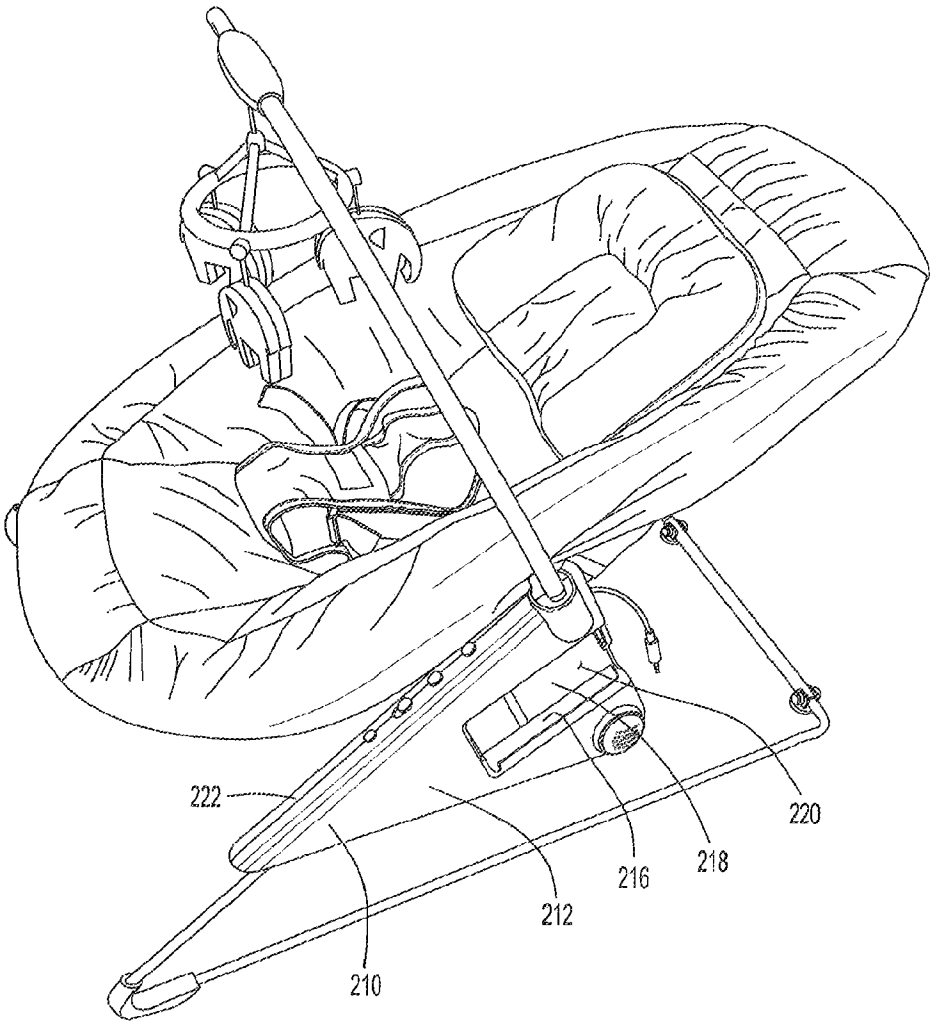
FIG. 9 illustrates a perspective view of the infant support structure illustrated in FIG. 4 with its cover removed.
Figure 10:
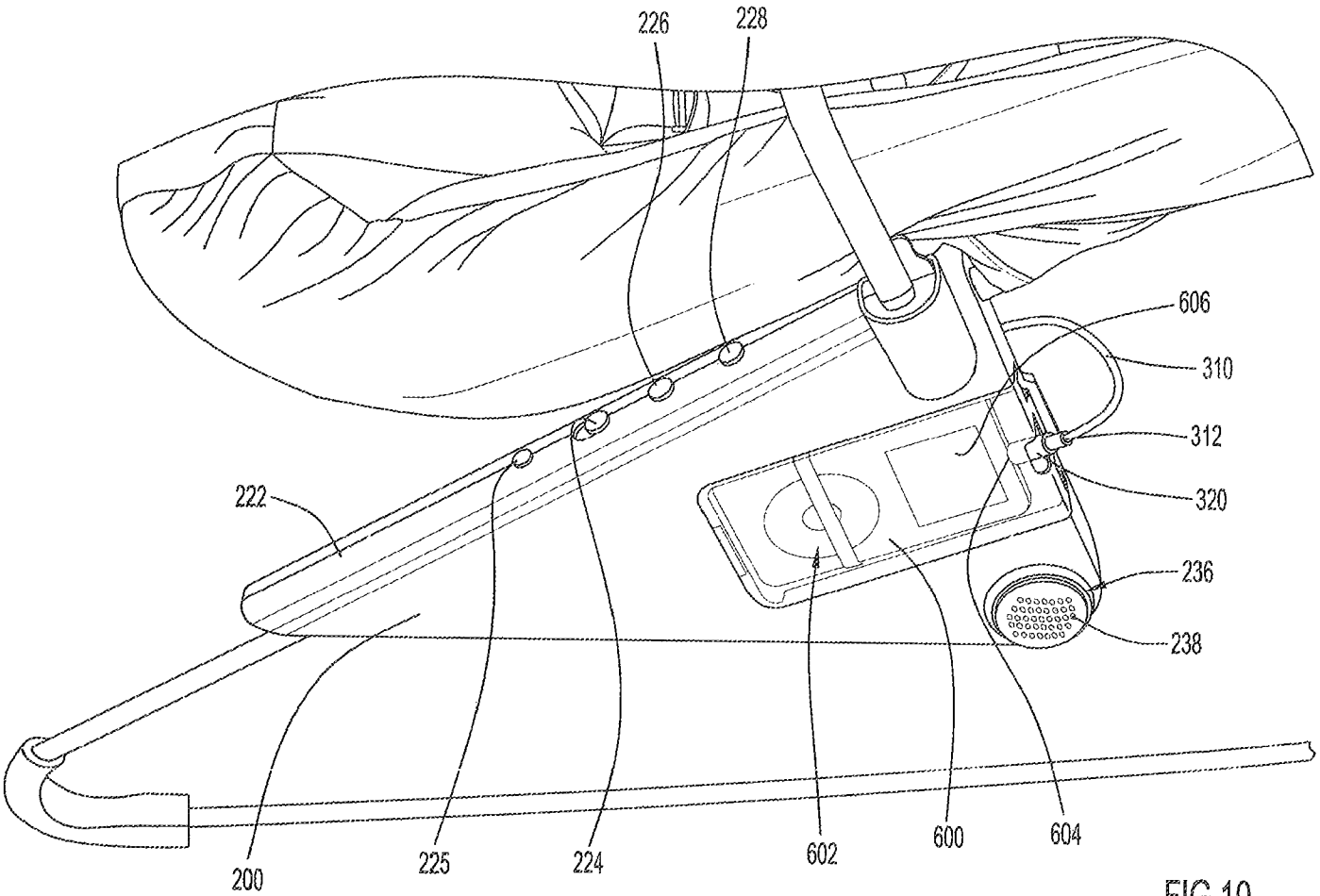
FIG. 10 illustrates a side view of the infant support structure illustrated in FIG. 4 with an electronic device mounted in the receptacle of the frame.

Referring to FIGS. 9 and 10, the connector 200 includes an upper side 222 with several controls. As shown in FIG. 10, an indicator 225 is provided which can be illuminated to indicate that the system of the connector 200 is on. Several push buttons 224, 226, and 228 are provided to allow a user to provide inputs as to the functionality or operation of the system. As shown in FIG. 9, the connector 200 includes a side wall or surface 216 and a lower wall or surface 218 that collectively define the receptacle 220. As shown in FIG. 10, the connector 200 includes a speaker portion 236 with several holes 238 that permit sound to be emitted from a transducer or speaker disposed in the connector 200.

Referring to FIG. 10, an electronic device 600 is disposed in the receptacle 220. The electronic device 600 includes a control portion 602 and a port 604 and may also include a display or screen 606. In different embodiments, the configuration and functionality of the electronic device that is used with the infant support structure 100 can vary. The connection 300 includes a wire 310 having an end 312 to which a jack or connector 320 is attached. The connector 320 is configured to be inserted into the port 604 on the electronic device 600, which may centrally located on the device 600 or disposed proximate to one of the sides of the device 600.

Figure 11:
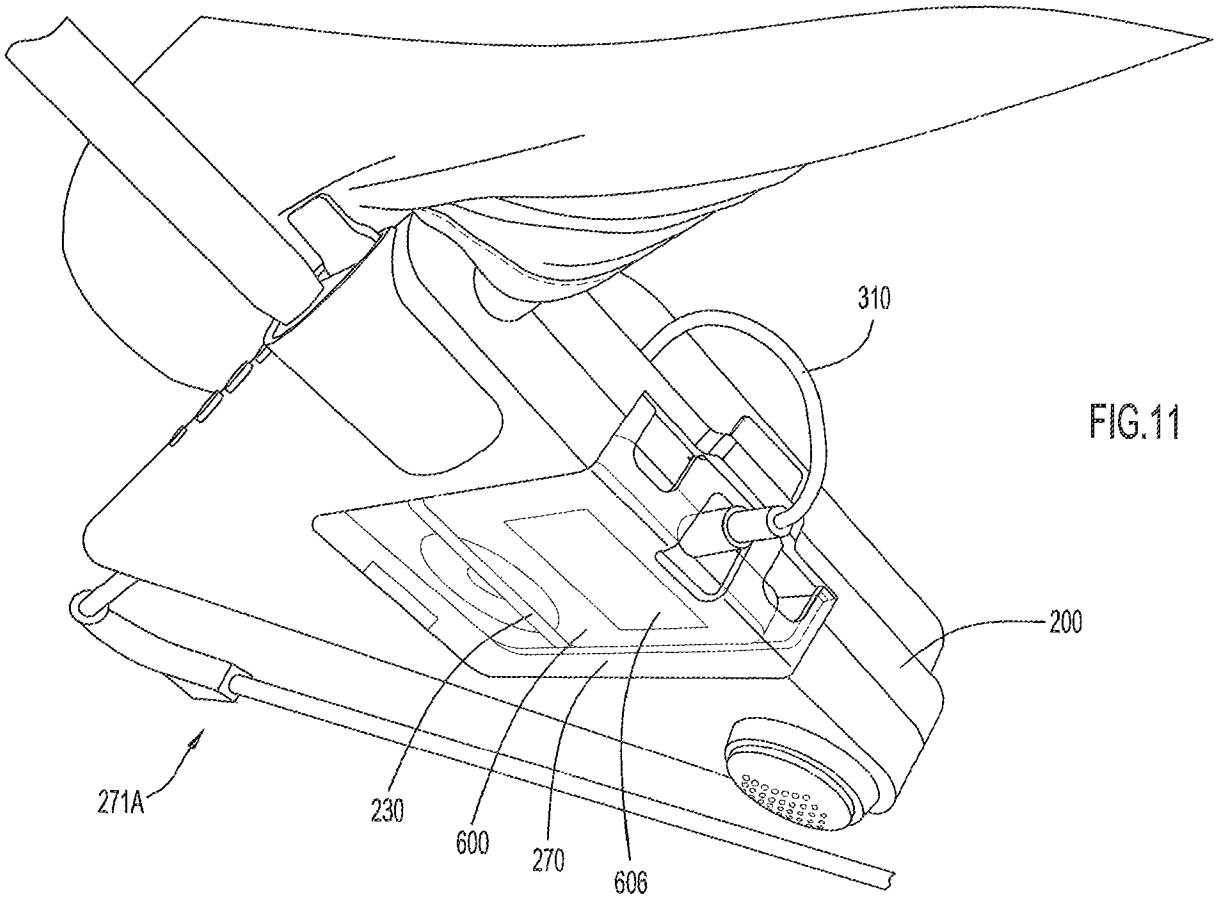
FIG. 11 illustrates a rear perspective view of the infant support structure illustrated in FIG. 10.
Figure 12:
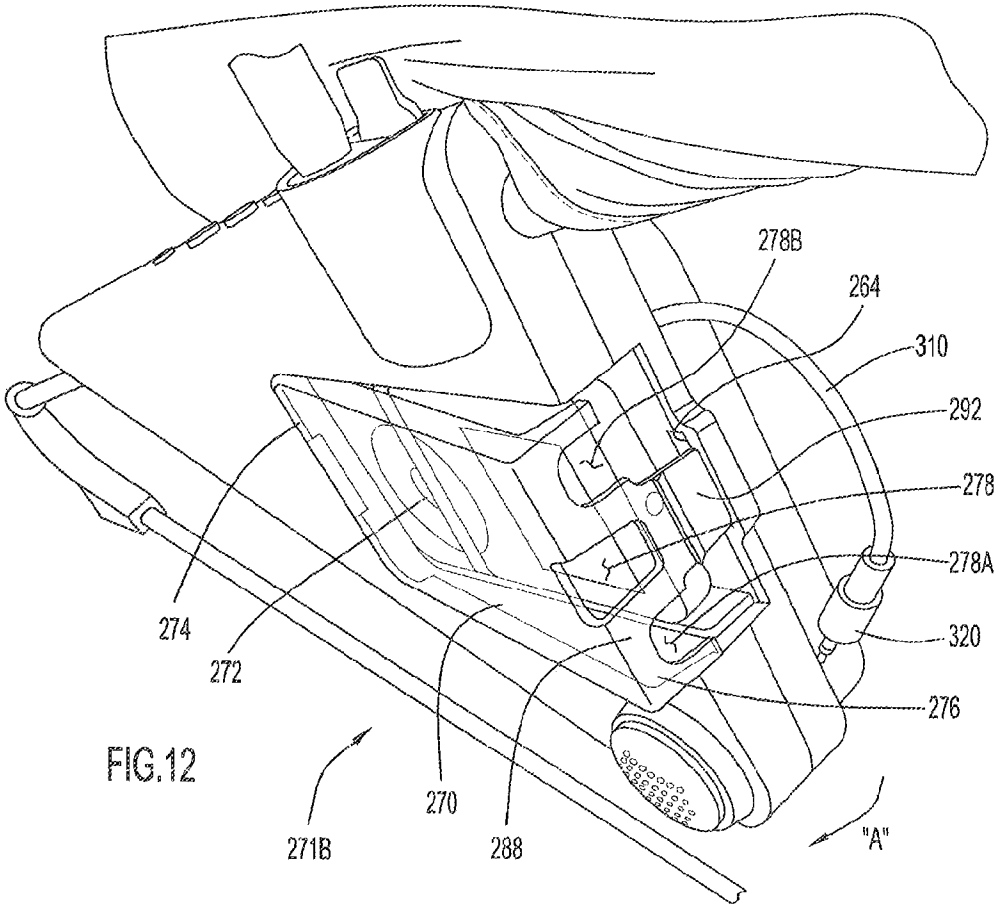
FIG. 12 illustrates a rear perspective view of the infant support structure illustrated in FIG. 11 with the cover moved to an unlocked position.

Referring to FIG. 11, the housing or connector 200 includes a retaining member 230 that can be used to mount or couple the electronic device 600 in the receptacle 220 and to the body 210. The retaining member 230 can be an elongate member and may include elastic properties. As shown, the cover 270 is coupled to the body of the connector 200 to provide protection to the electronic device 600. The cover 270 is made of a transparent material, such as plastic, which allows a parent or caregiver to view the electronic device 600 and in particular, the display 606. In FIG. 11, the cover 270 is illustrated in a closed or locked position 271A. Referring to FIG. 12, the cover 270 has been moved from its closed or locked position 271A illustrated in FIG. 11 to an opened or unlocked position 271B. In particular, the cover 270 is moved along the direction of arrow "A" to its opened or unlocked position 271B.

Figure 13:
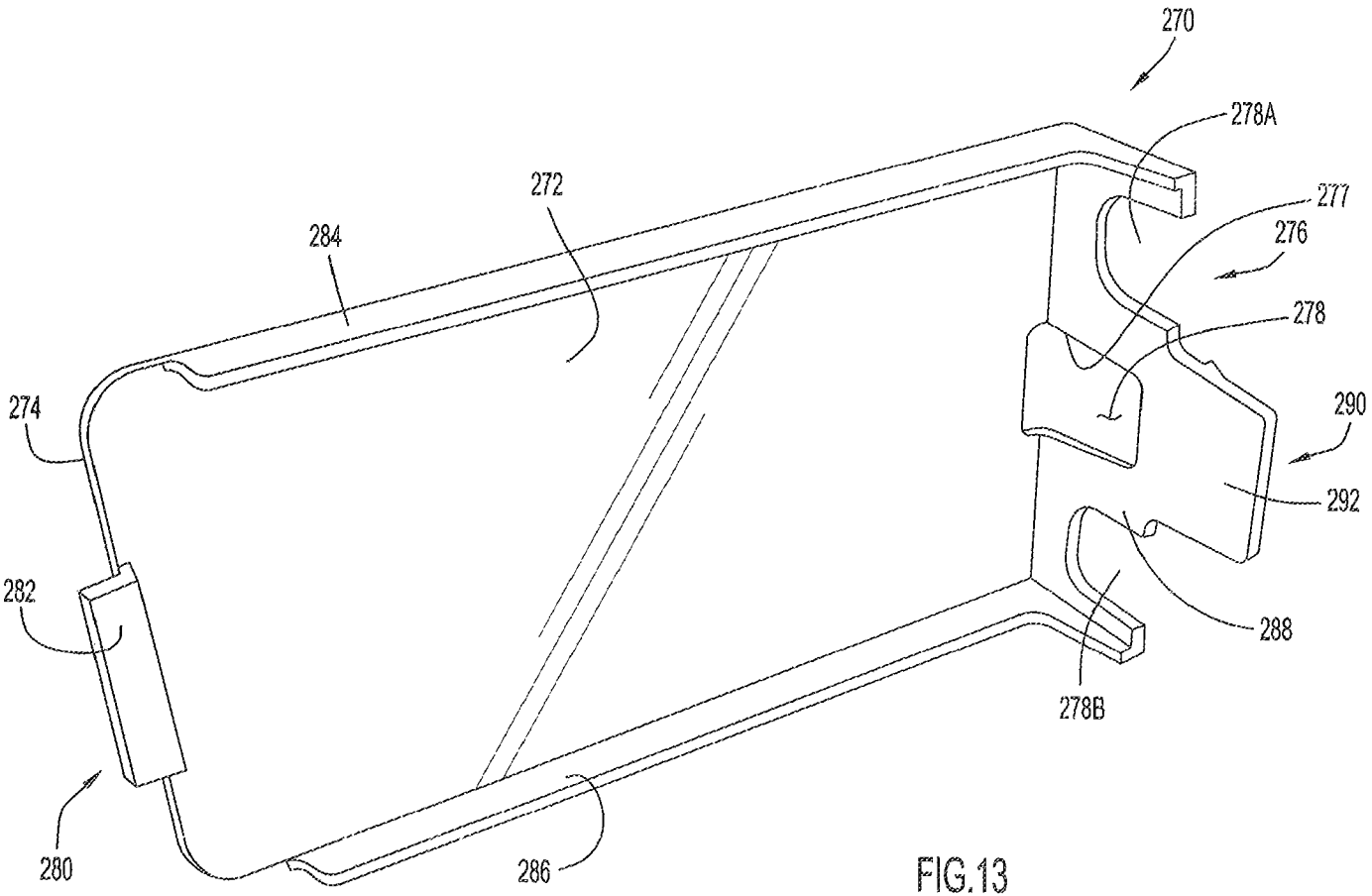
FIG. 13 illustrates a perspective view of an embodiment of a cover of the infant support structure illustrated in FIG. 4.
Figure 14:
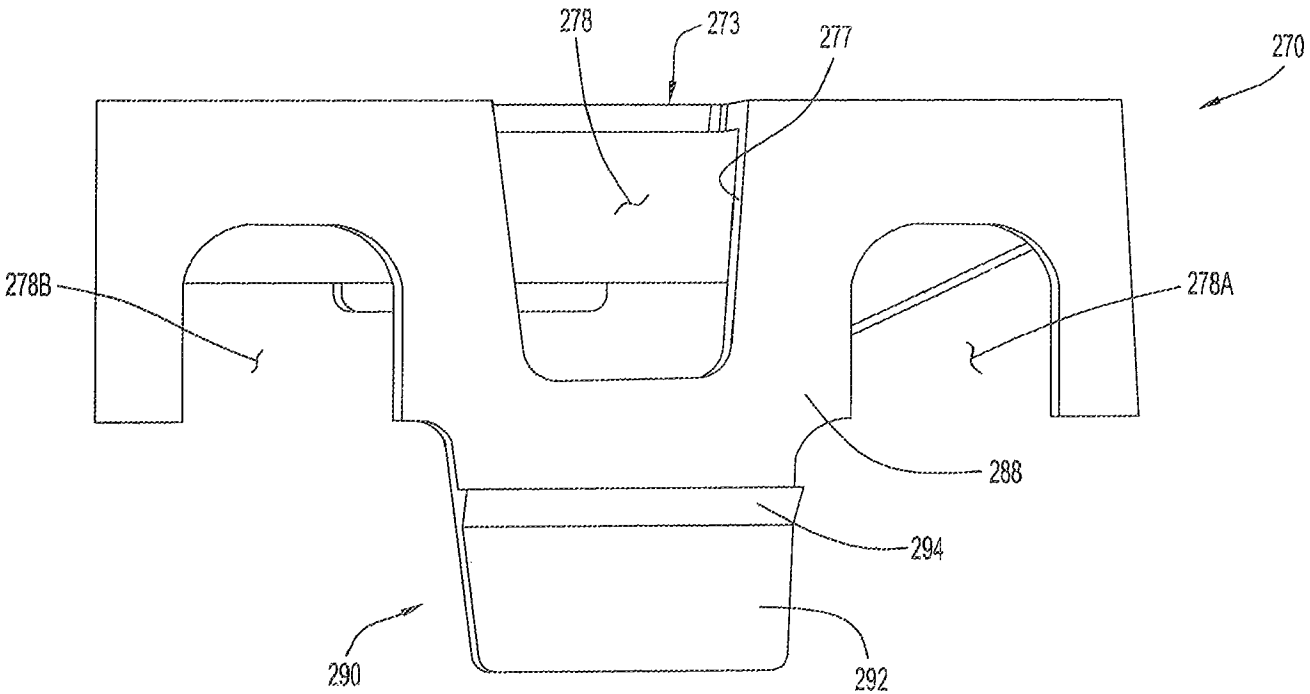
FIGS. 14 and 15 illustrate an end view and a side view, respectively, of the cover illustrated in FIG. 13.
Figure 15:
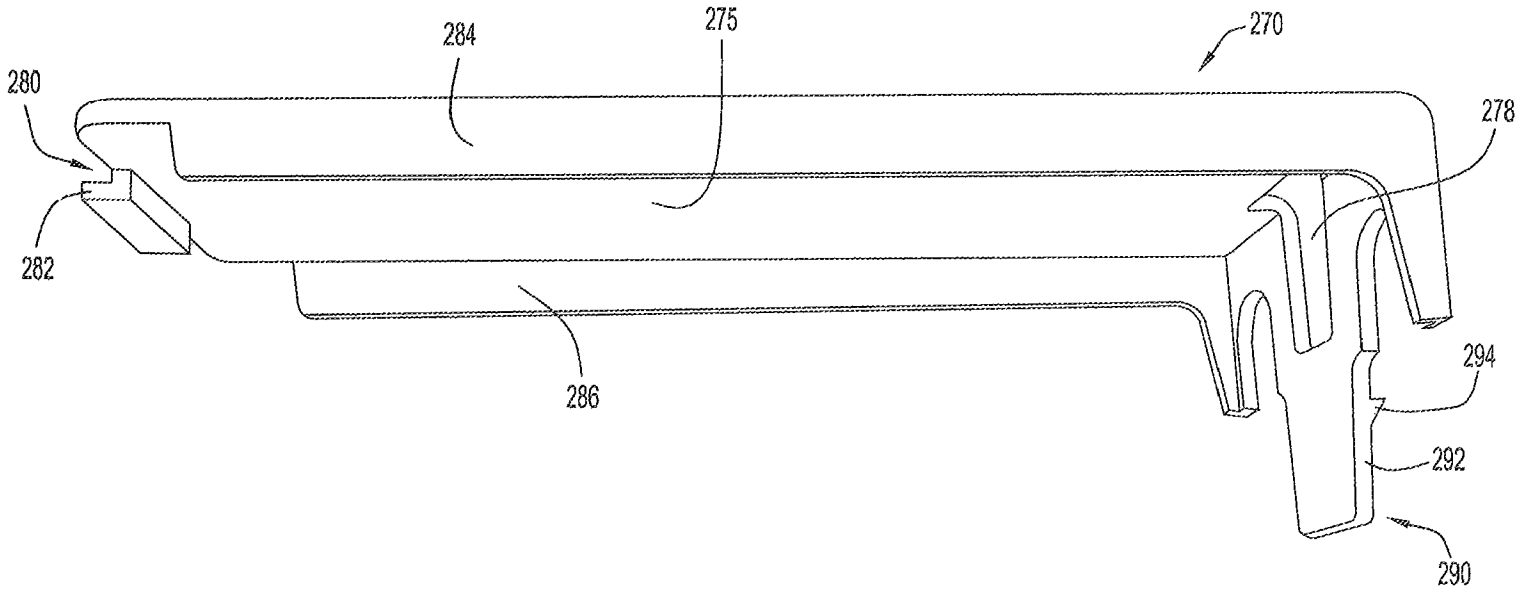

Referring to FIGS. 12-15, the cover 270 includes a body 272 with opposite ends 274 and 276. The body 272 also includes an outer surface 273 (see FIG. 14) and an inner surface 275 (see FIG. 15). Proximate to end 276 of the body 272 is an end wall 288 that has several openings 278, 278A, and 278B formed therein. In this embodiment, the edge 277 that defines the opening 278 as well as the opening 278 are centrally located along the plate 278 and end 276. Openings 278A and 278B are formed as notches, but could be enclosed openings similar to opening 278 in different embodiments. The end wall 288 also includes a coupling portion 290 as shown in FIGS. 14 and 15. Coupling portion 290 includes a tab 292 from which a projection 294 extends. The tab 292 is configured to be inserted into opening 264 on connector 200 and the projection 294 engages the bar 262 to secure the tab 292 against movement.

As shown in FIGS. 13 and 14, the cover 270 includes a coupling portion 280 disposed proximate to end 274. The coupling portion 280 includes a tab 282 that extends outwardly from the body 272 of the cover 270. The tab 282 may be inserted into an opening proximate to the receptacle 220 as discussed below with respect to FIGS. 16 and 17. As shown in FIGS. 13 and 15, the cover 270 also includes side walls or portions 284 and 286 that extend from body 272. The side walls 284 and 286 engage corresponding surfaces proximate to the receptacle 220 as set forth below.

Figure 16:
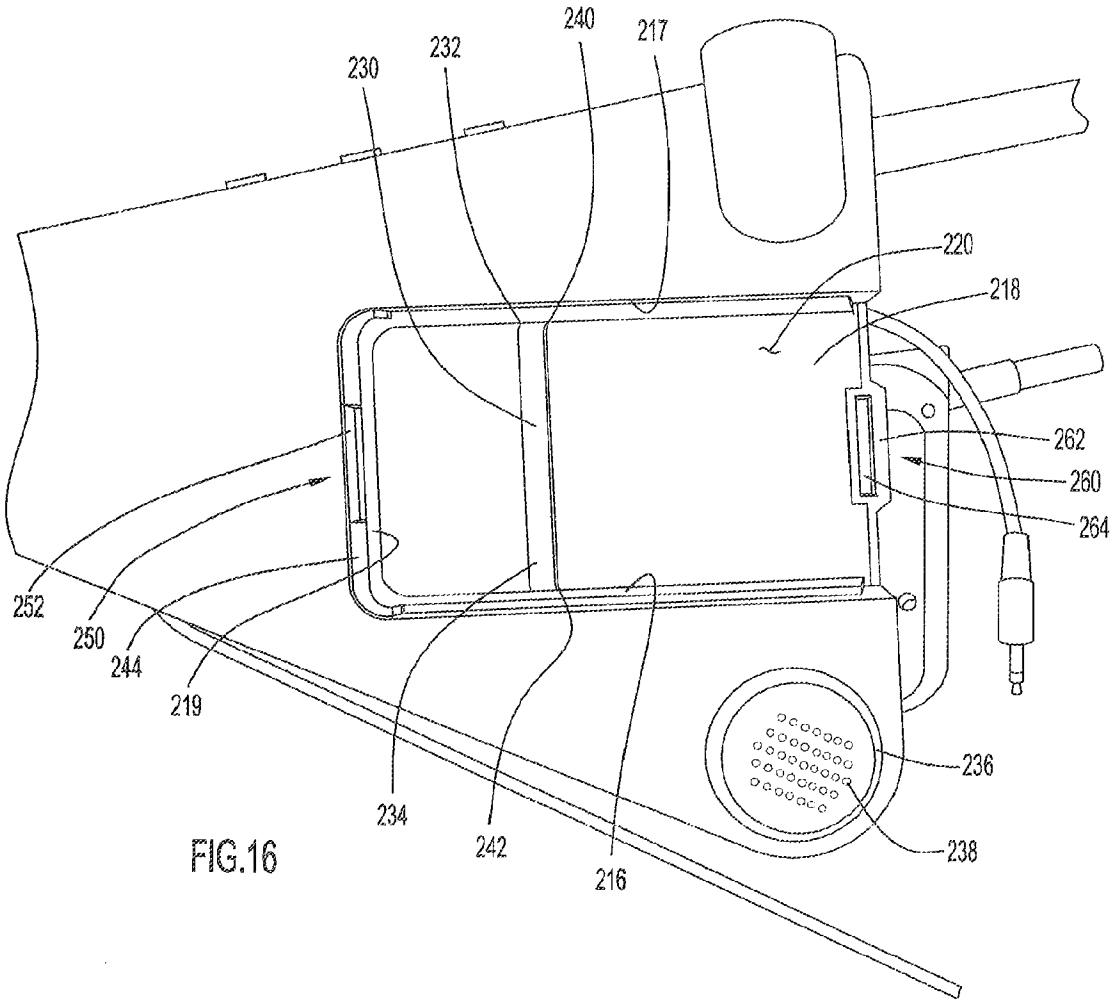
FIGS. 16 and 17 illustrate a side view and a rear perspective view, respectively, of the connector illustrated in FIG. 10 with the cover and electronic device removed.
Figure 17:
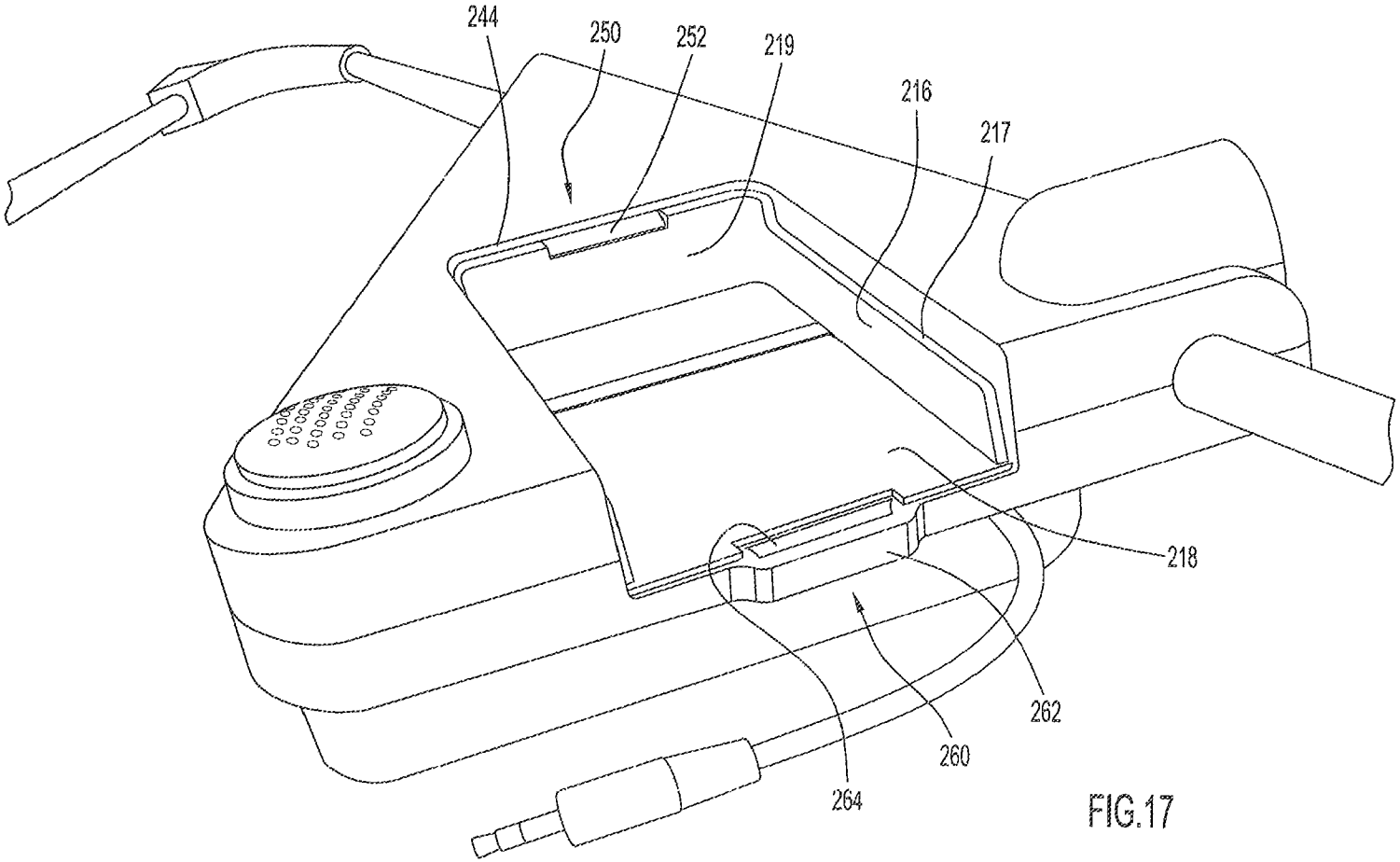

Referring to FIGS. 16 and 17, some of the features of the connector 200 are illustrated. As previously discussed, side wall 216 and lower wall 218 define a receptacle 220 configured to receive an electronic device. The coupling portion 260 with bar 262 defining a receiving area 264 is shown at one end of the receptacle 220. At the other end of the receptacle 220, proximate to end 219, is coupling portion 250 which includes an opening 252 that is configured to receive the tab 282 of the cover 270. When mounting the cover 270 to the housing 200, tab 282 is initially inserted into opening 252 and then tab 292 is inserted into opening 264.

Referring to FIG. 16, openings 240 and 242 are formed on opposite sides of the receptacle 220. The ends 232 and 234 of the retaining member 230 are inserted into the openings 240 and 242, respectively. The retaining member 230 has elastic properties and can be used with electronic devices having varying sizes or configurations to retain the particular electronic device in the receptacle 220.

Each of the side walls 216 includes an upper edge or surface 217 that extends therealong. The edges 217 are engaged by side walls 284 and 286 of the cover 270 when the cover 270 is positioned in its locked or closed position on the connector 200. As shown in FIG. 17, an edge or surface 244 is formed along end 219. The edge 244 includes the opening 252 formed therein and is offset from edge 217. The inner surface of the cover body 272 near end 274 engages edge 244 when the cover 270 is coupled to the connector 200.

Figure 18:
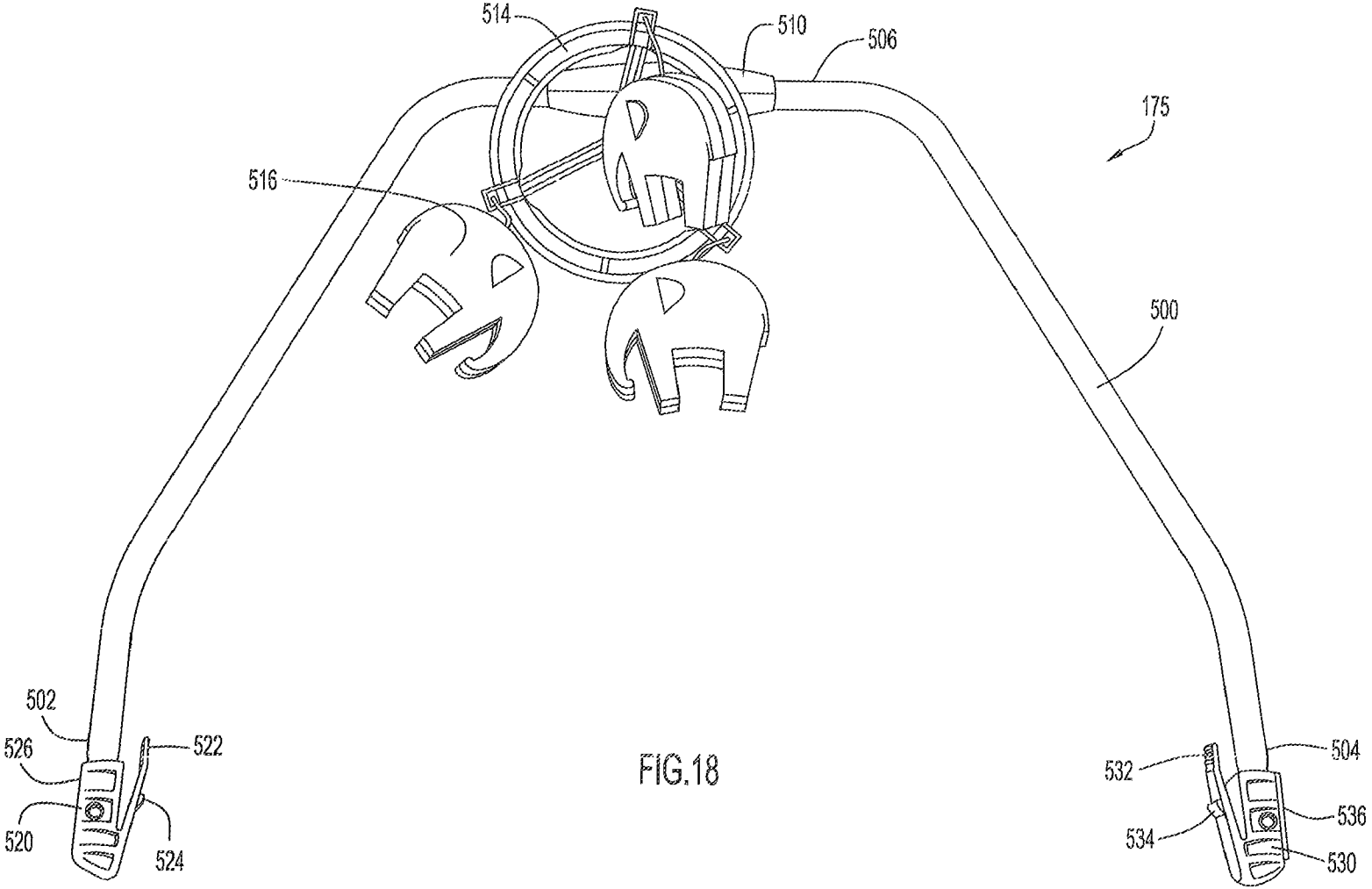
FIG. 18 illustrates a front view of a toy bar of the infant support structure illustrated in FIG. 4.
Figure 19:
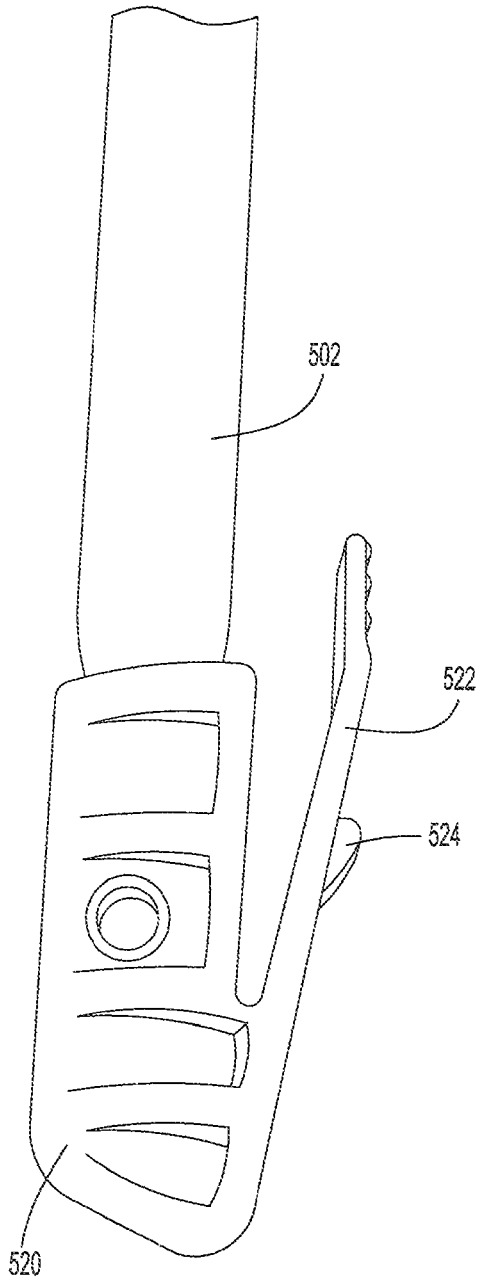
FIG. 19 illustrates a close-up side view of a coupler of the toy bar illustrated in FIG. 18.

Referring to FIGS. 18 and 19, the entertainment portion 175 includes a toy bar 500 with ends 502 and 504 and a middle portion 506. As mentioned above, a mounting portion 510 is coupled to the toy bar 500. The mounting portion 510 supports a mobile 514 that includes objects 516 supported thereon. At end 502 is a mounting portion 520 that has a release portion 522 with a detent 524 and an alignment guide 526. Similarly, near end 504 is a mounting portion 530 that has a release portion 532 with a detent 534 and an alignment guide 536.

Figure 20:
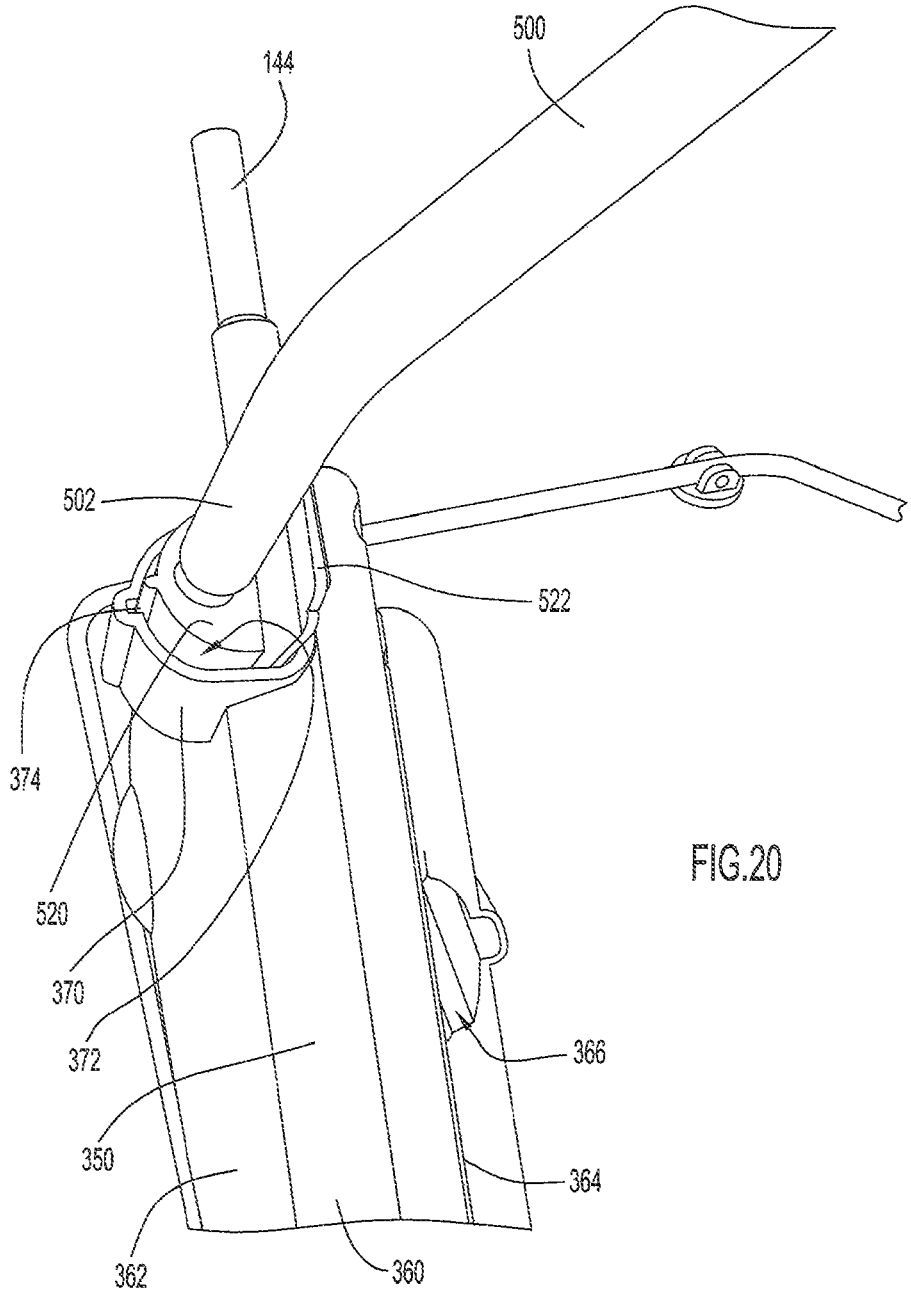
FIG. 20 illustrates a top view of the mounting of the toy bar illustrated in FIG. 18 to a connector of the infant support structure.

As shown in FIG. 20, connector 350 includes a body 360 with an outer side 362 and an inner side 364. A receptacle 366 is formed on the inner side 364 of the body 360. The receptacle 366 is configured to receive 184 of portion 180. Body 360 also includes a mounting portion 370 that defines a receptacle 372 with a slot 374. The mounting portion 520 on the end 502 of the toy bar 500 can be inserted into the receptacle 372 as shown. The release mechanism 522 can be manipulated to decouple the mounting portion 520 from the connector 200.

Referring to FIGS. 21-24, an embodiment of softgoods or a softgoods assembly according to the present invention is illustrated. The softgoods 400 forms part of the child receiving portion 170 of the frame 110. The softgoods 400 is configured to be mounted on the upper member 160 and the lower member 180 so that an infant can be disposed thereon.

Figure 21:
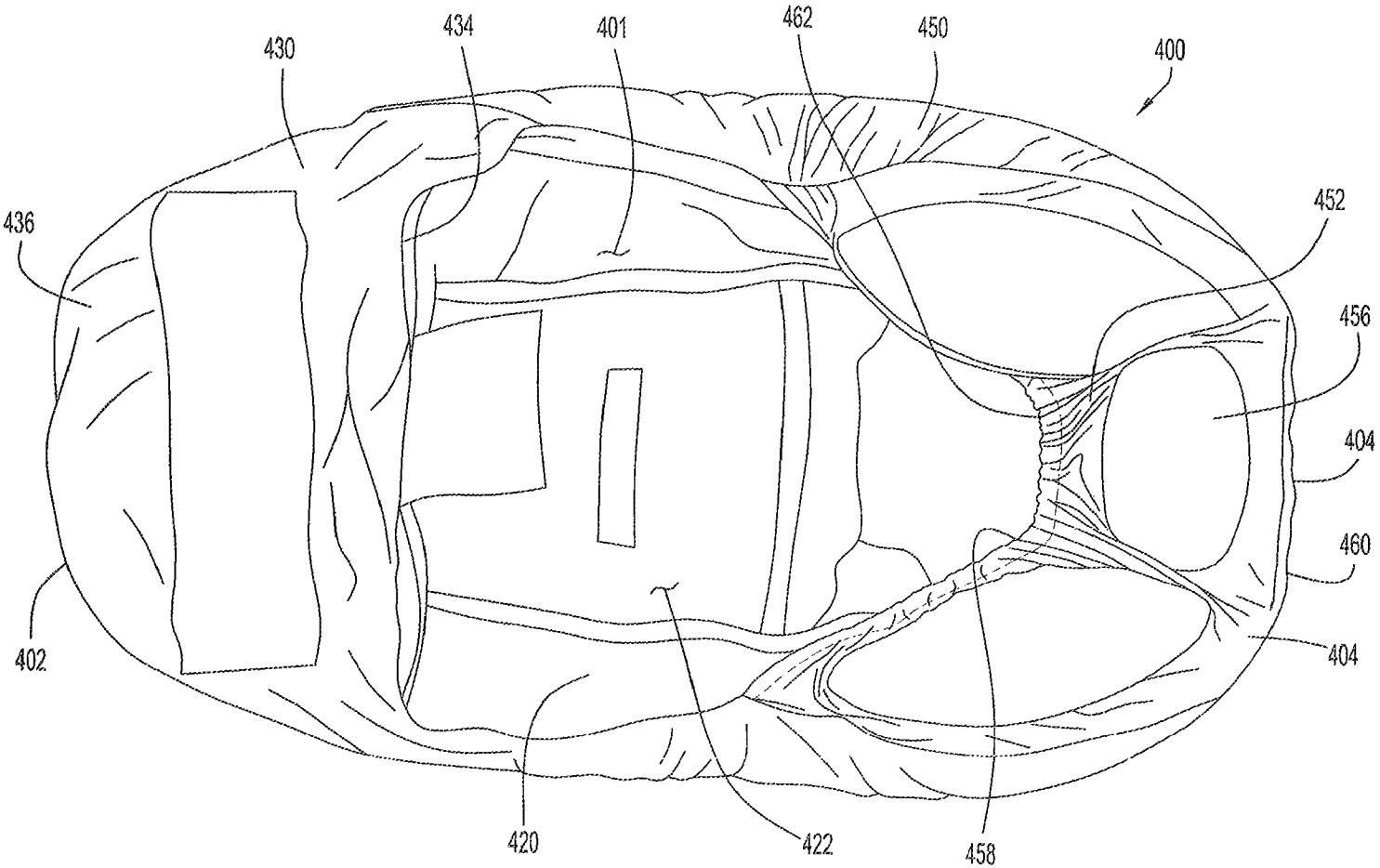
FIG. 21 illustrates a bottom view of an embodiment of a support portion according to the present invention.
Figure 22:
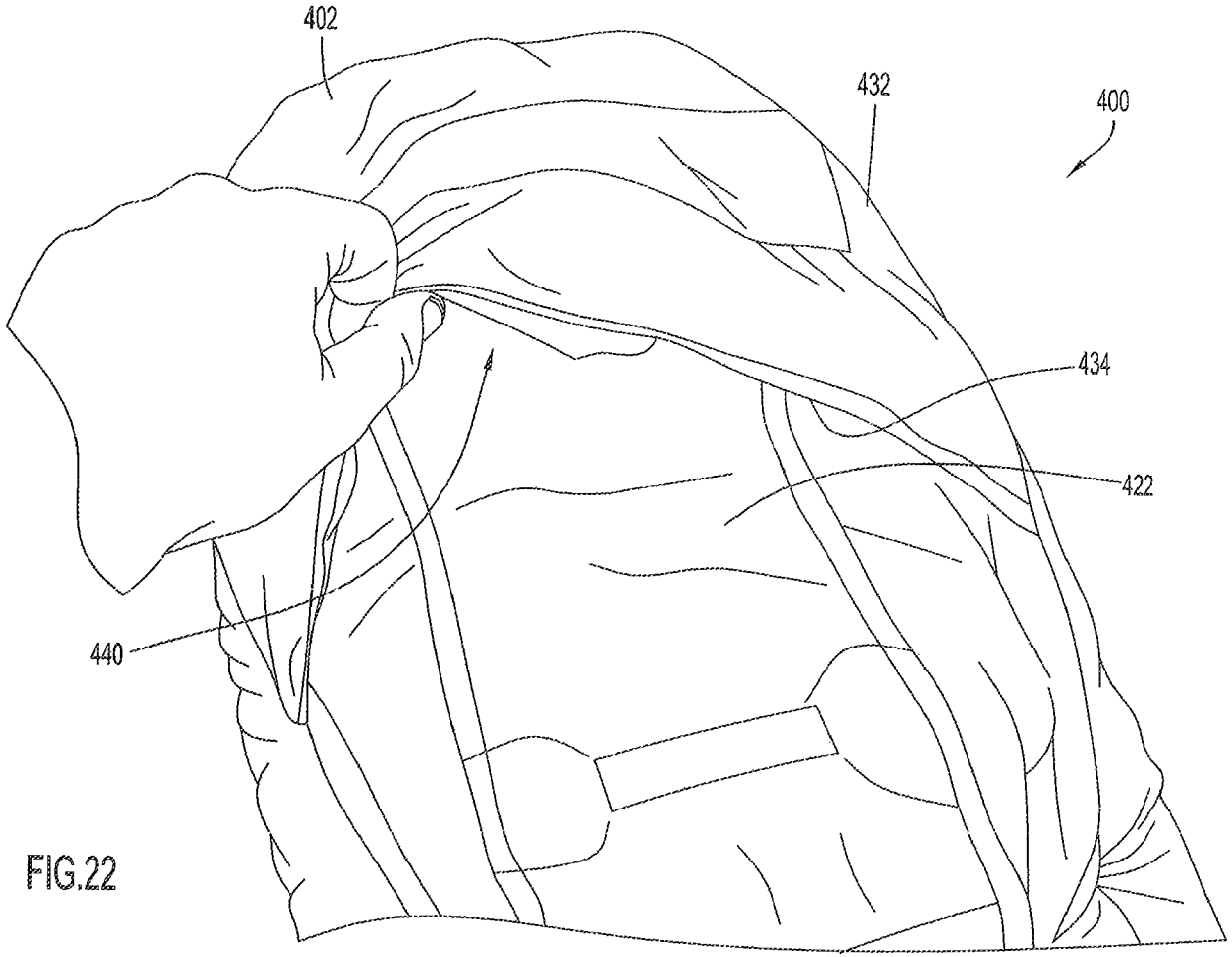
FIG. 22 illustrates a bottom perspective view of a first end of the support portion illustrated in FIG. 21.

Referring to FIG. 21, a view of the lower side of the softgoods 400 is illustrated. Softgoods 400 is a body or body portion 401, such as a pad, that includes padding or filling that provides comfort to an infant. The thickness of the body 401 can vary in different embodiments. The body 401 has opposite ends 402 and 404, an upper side 410 and a lower side 420 that has a lower surface 422. End 402 may be referred to as an upper end as it is coupled to the upper end of the frame. End 404 may be referred to as a lower end as it is coupled to the lower end of the frame. Proximate to end 402 is a mounting portion 430 that includes a body or panel 432 of material, such as fabric. As shown in FIGS. 21 and 22, the body 432 has one end 436 coupled, such as by sewing, to end 402 of body 401 and an opposite end 434 that is detached from body 401. The body 432 and the surface 422 of body 401 collectively define a receptacle 440 that is configured to receive a portion of the frame 110, such as upper member 160.

Figure 23:
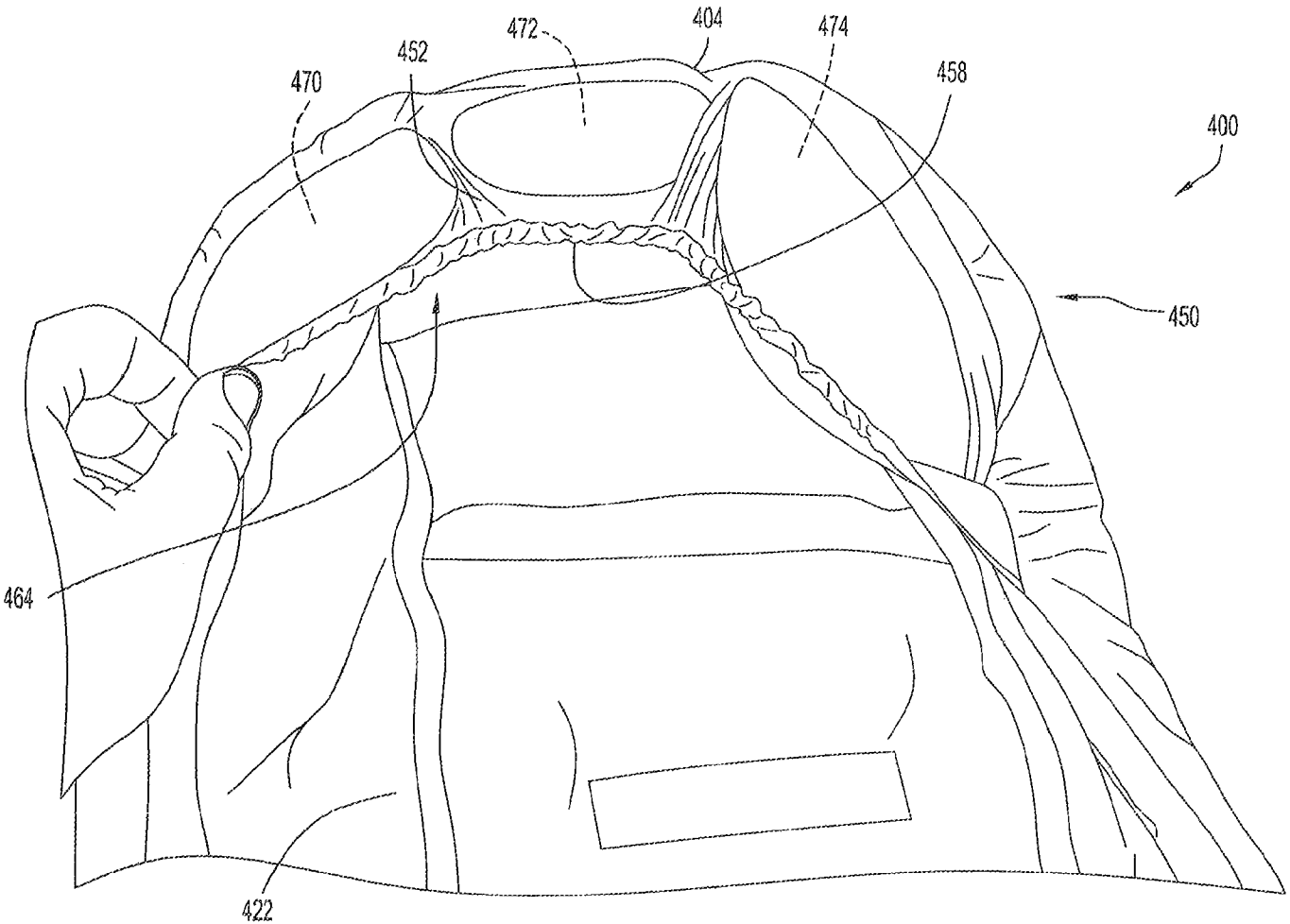
FIG. 23 illustrates a bottom perspective view of a second end of the support portion illustrated in FIG. 21.
Figure 24:
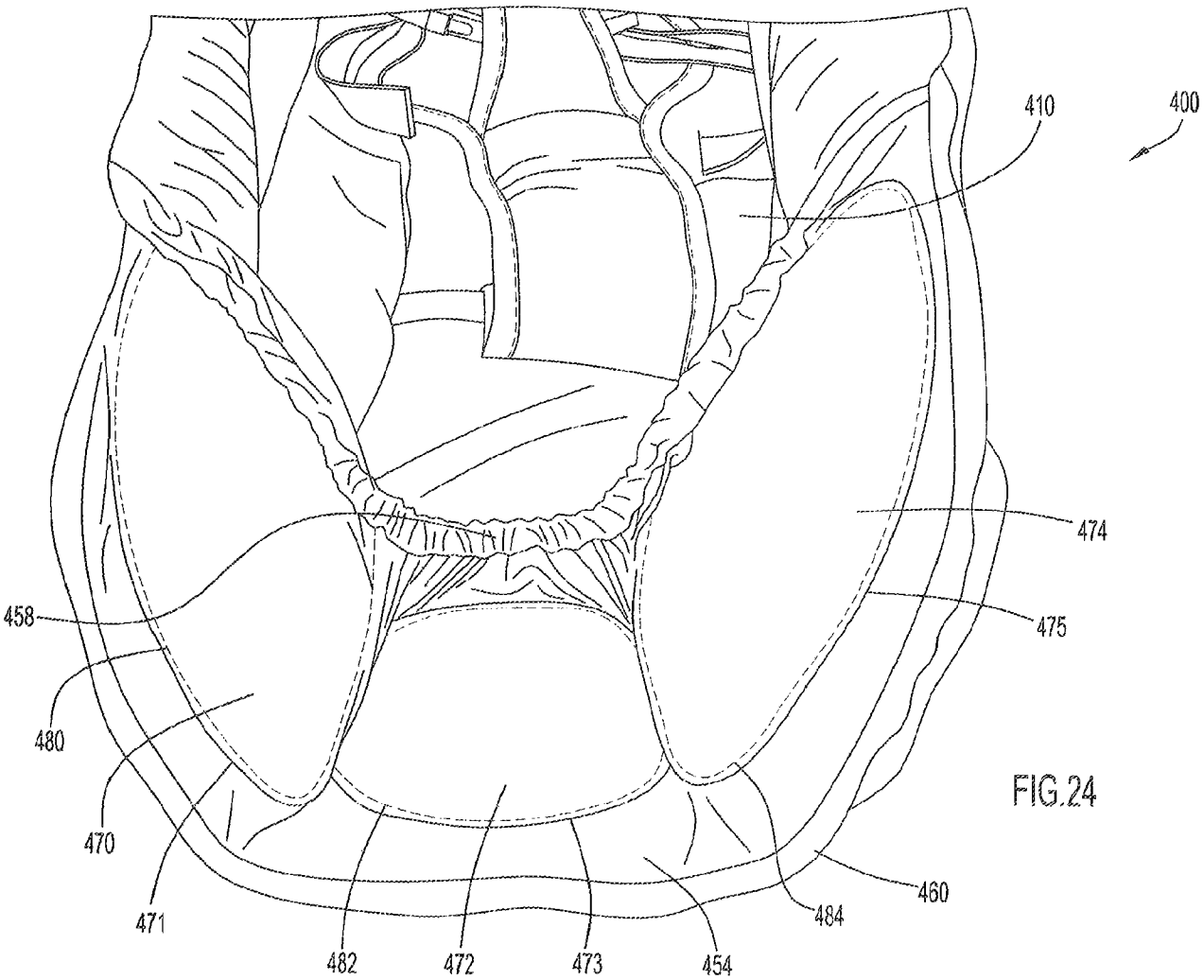
FIG. 24 illustrates a view of the inner surface of the second end of the support portion illustrated in FIG. 21.

As shown in FIGS. 21 and 23-24, proximate to end 404 is a mounting portion 450 that is used to mount the softgoods 400 to the frame 110 as well. Mounting portion 450 includes a body 452 with an inner surface 454 (see FIG. 24), an outer surface 456, and opposite ends 458 and 460. End 460 is coupled to the body 401, such as by sewing, and end 458 is detached from the body 401. In one implementation, an elastic member 462 is sewn along a portion of end 458 of mounting portion 450. As shown in FIG. 23, the body 452 of mounting portion 450 forms a receptacle 464 with surface 422 in which a portion of the frame, such as frame portion 180, can be inserted. In different embodiments, the size and configuration of each of the mounting portions 450 and 450 can vary.

FIG. 23 illustrates the outer surface of the mounting portion 450 and FIG. 24 illustrates the inner surface of the mounting portion 450. As shown in FIG. 23, the mounting portion 450 includes several supports or resilient members 470, 472, and 474 coupled to the inner surface of the mounting portion 450. The resilient members 470, 472, and 474 are plastic pieces that may vary in size or configuration.

Referring to FIG. 24, the mounting portion 450 has been inverted relative to the body 401 of the softgoods 400 so that the inner surface 454 is exposed. The supports or resilient members 470, 472, and 474 are coupled to the inner surface 454. In one embodiment, the resilient members 470, 472, and 474 have respective edges or perimeters 471, 473, and 475 along each of which stitching 480, 482, and 484 is provided to couple the resilient members 470, 472, and 474 to the body 452. In other embodiments, the resilient members can be coupled to the mounting portion body using an adhesive or other conventional coupling technique or mechanism.

Figure 25:
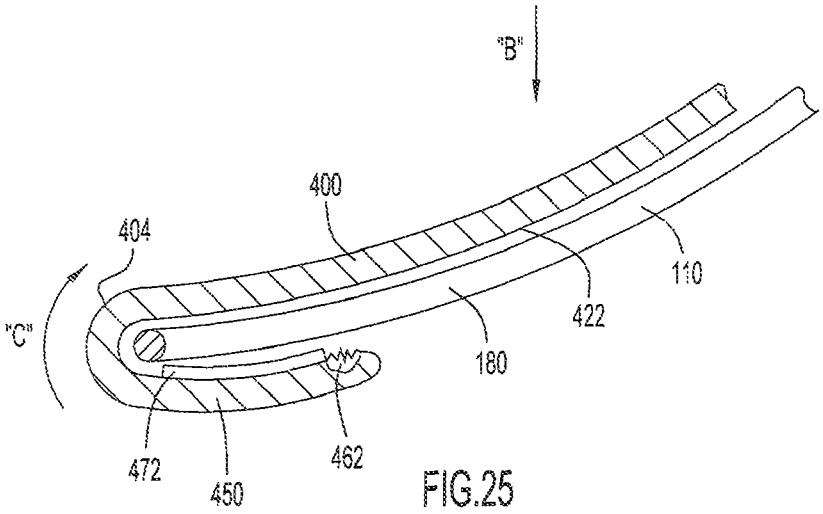
FIG. 25 illustrates a partial cross-sectional side view of some components of the infant support structure illustrated in FIG. 4

Referring to FIG. 25, the function of the resilient members is illustrated. When an infant or child is placed on the softgoods 400, the weight of the infant creates a downward force along the direction of arrow "B." This force causes the portion of the softgoods 400 near end 404 to move along the direction of arrow "C." If the softgoods 400 moves too far along that direction, the mounting portion 450 moves around the end of frame member 180 and end 404 of the softgoods 400 is no longer coupled to the frame 110. The elastic member 462 maintains the end 458 of the mounting portion 450 close to the surface 422 of the softgoods body 401. In FIG. 25, only one resilient member 472 is coupled to the mounting portion 450. Resilient member 472 prevents the movement of the mounting portion 450 along the direction of arrow "C" by having sufficient stiffness to resist rolling over the end of the frame member 180.

In alternative embodiments, the quantity and the size and configuration of the supports or resilient members for a mounting portion can vary. For example, a single support or resilient member can be coupled to the mounting portion. Alternatively, the side of the mounting portion to which any support or resilient member can be mounted may vary. For example, one or more supports or resilient members can be coupled to the outer surface of the mounting portion. Alternatively, one or more resilient members can be coupled to the inner surface of the mounting portion and one or more resilient members can be coupled to the outer surface of the mounting portion. In yet another alternative embodiment, each mounting portion of the softgoods may include one or more supports or resilient members coupled thereto.

Figure 26:
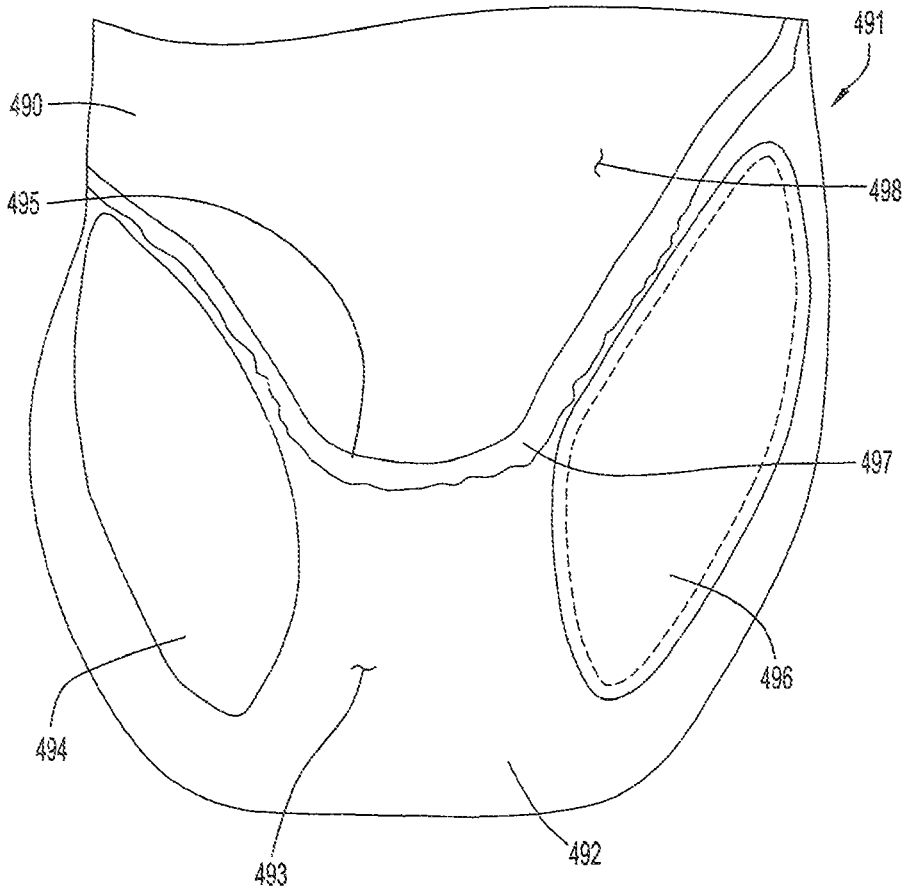
FIG. 26 illustrates a view of the inner surface of the second end of an alternative embodiment of a support portion according to the present invention.

Referring to FIG. 26, an alternative embodiment of a part of a softgoods portion according to the present invention is illustrated. In this embodiment, the softgoods 490 includes a lower surface 498 and a mounting portion 491 coupled proximate to one end of the softgoods 490. The mounting portion 491 includes a body 492 with an outer surface 493 to which supports or resilient members 494 and 496 are coupled. In this embodiment, an elastic member 497 may be coupled along a portion of the end 495 of the body 492 by stitching or other coupling technique.

In an alternative embodiment, the softgoods portion 400 may include a clip, buckle or other fastener or fastening mechanism in lieu of the body or panel that defines mounting portion 430. As a result, the mounting portion in that embodiment of the softgoods portion 400 does not form a receptacle.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. An infant support structure, comprising:

a base frame portion configured to engage a support surface, the base frame including a first side, an opposite second side, an upper portion, and a lower portion, wherein the upper portion may flex relative to the lower portion to provide an oscillatory motion for an infant in the infant support structure;

a seat frame portion, the seat frame portion being configured to support an infant; and a coupling assembly, the coupling assembly being coupled to the base frame portion and to the seat frame portion, the coupling assembly being configured to support the seat frame portion on the base frame portion, the coupling assembly including:

a first housing located on the first side of the base frame portion; and a second housing located on the second side of the base frame portion, the second housing defining a receptacle therein, the receptacle being configured to receive a portable electronic device, the receptacle being configured so that the portable electronic device is removable from the housing, the housing including an output generating device configured to generate an output based on signals from the portable electronic device.

2. The infant support structure of claim 1, the upper portion being configured to be coupled to the lower portion, the first and second housings of the coupling assembly being connected to an upper end of the upper portion.

3. The infant support structure of claim 1, wherein the seat frame portion includes a tubular member with a first end and a second end, and the first housing is configured to receive the first end and the second housing is configured to receive the second end of the tubular member.

4. The infant support structure of claim 1, wherein the second housing includes a cover removably coupled thereto, the cover being configured to cover the receptacle.

5. The infant support structure of claim 4, wherein the cover has an opening formed therein, the opening being configured to receive a connection therethrough so that the connection can be coupled to the portable electronic device.

6. The infant support structure of claim 5, wherein the second housing includes a wire with a jack extending therefrom, the opening in the cover being configured to receive the wire and the jack therethrough.

7. The infant support structure of claim 4, wherein the second housing includes a mounting portion that defines a receiving area, the receiving area being configured to receive a portion of the cover to couple the cover to the second housing.

8. The infant support structure of claim 1, wherein the second housing includes a retaining member proximate to the receptacle, the retaining member being elastic and configured to retain the portable electronic device in the receptacle.

9. A bouncer, comprising:

a base frame portion including an upper portion and a lower portion, wherein the upper portion may flex relative to the lower portion-for providing a bouncing motion to a child in the bouncer;

a child receiving portion;

a first connector, the first connector being coupled to the lower portion and to the child receiving portion, the first connector being disposed on a first side of the bouncer; and a second connector, the second connector being coupled to the lower portion and to the child receiving portion, the second connector being disposed on a second side of the bouncer opposite the first side, the first connector and second connector being configured to support the child receiving portion on the lower portion, the second connector including a receptacle formed therein to receive a portable electronic device and a cover removably coupled thereto, the cover being configured to cover the receptacle, the receptacle being configured so that the portable electronic device is removable from the second connector, the second connector including an electronic system that is configured to generate an output based on signals from the portable electronic device.

10. The bouncer of claim 9, wherein the base frame portion is a wire frame, and the child receiving portion includes a tubular member coupled to the first connector and the second connector, the child receiving portion including softgoods coupled to the child receiving portion to support an infant thereon.

11. The bouncer of claim 9, wherein the second connector includes a first mounting portion and a second mounting portion, each of the first mounting portion and the second mounting portion being located proximate to the receptacle, the first mounting portion being configured to receive a first portion of the cover and the second mounting portion being configured to receive a second portion of the cover.

12. The bouncer of claim 9, wherein the cover has an opening formed therein, the opening being configured to receive an electrical connection therethrough, the electrical connection being configured to couple the portable electronic device to the electronic system.

13. The bouncer of claim 9, wherein the second connector includes a retaining member proximate to the receptacle, the retaining member being elastic and configured to retain the portable electronic device in the receptacle.

* * * * *